US006112939A

United States Patent [19]

Yoshie

[11] Patent Number: 6,112,939

[45] Date of Patent: Sep. 5, 2000

[54] CARTRIDGE FOR HOUSING CONNECTED CLIP BODY OF CLIP MEMBERS

[75] Inventor: Toru Yoshie, Tokyo, Japan

[73] Assignee: Max Co., Ltd., Tokyo, Japan

[21] Appl. No.: 08/982,070

[22] Filed: Dec. 1, 1997

[30] Foreign Application Priority Data

Nov. 29, 1996 [JP] Japan ..... 8-320440
Dec. 3, 1996 [JP] Japan ..... 8-323094

[51] Int. Cl.[7] ..... B27F 7/17

[52] U.S. Cl. ..... 221/197; 227/120; 227/3

[58] Field of Search ..... 227/155, 154, 227/3, 4, 2, 120; 29/243.56; 221/197; 270/58.08

[56] References Cited

U.S. PATENT DOCUMENTS

| | | | |
|---|---|---|---|
| 4,083,550 | 4/1978 | Pal | 270/58.08 |
| 4,488,662 | 12/1984 | Fanning | 221/197 X |
| 4,557,263 | 12/1985 | Green | 221/197 X |
| 4,564,185 | 1/1986 | Hamlin et al. | 270/58.08 X |
| 4,946,154 | 8/1990 | Nakamura | 270/58.08 |
| 5,501,387 | 3/1996 | Yoshie | 227/120 |
| 5,560,529 | 10/1996 | Udagawa et al. | 227/120 X |
| 5,772,073 | 6/1998 | Deschenes | 221/197 |

FOREIGN PATENT DOCUMENTS 9-136271 5/1997 Japan .

*Primary Examiner*—William E. Terrell
*Assistant Examiner*—Patrick Mackey
*Attorney, Agent, or Firm*—Jacobson, Price, Holman & Stern, PLLC

[57] ABSTRACT

A cartridge is provided which is detachably attached to a main body of a unit. The main body of the unit houses a connected clip body where a plurality of clip plates are interconnected in ribbon form by tape and wound in roll form, and the main body is equipped with a device for clipping an end portion of a sheet bundle. The cartridge has a main body (103), which is in turn formed with a chamber (102) for housing the connected clip body and a conveyer path (113) for feeding a clip plate of the connected clip body housed in the housing chamber to a clipping position by a feed unit. The housing chamber (102) is provided with an opening (105A) at its circumferential wall (105) which becomes an inlet between the housing chamber (102) and the conveyer path (113). The opening (105A) has nearly the same diameter as the diameter of the housing chamber (102). The main body (103) of the cartridge is provided with a lid body (120) for opening or closing the opening (105A), and the inlet (113*a*) of the conveyer path (113) is faced to the opening (105A).

9 Claims, 38 Drawing Sheets

FIG. 41(B)
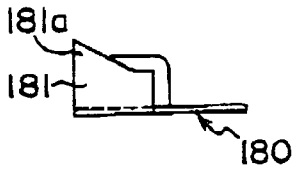
FIG. 41(C)
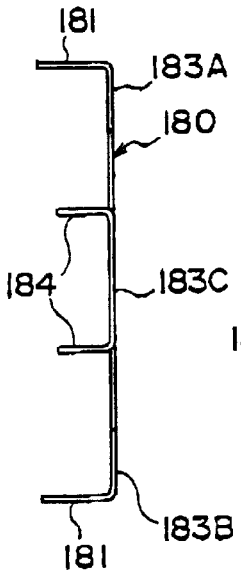
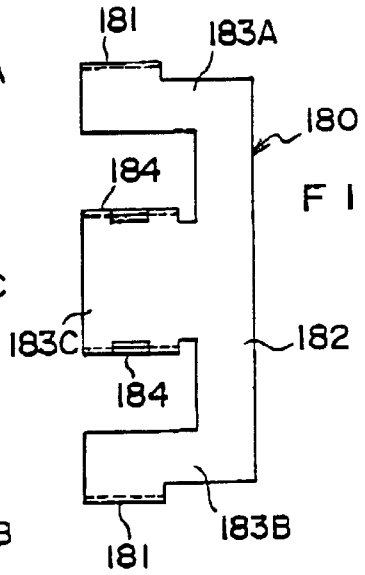
FIG. 41(A)

FIG. 42(B)
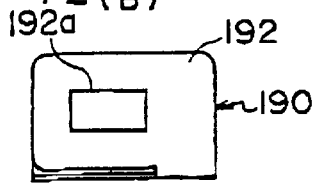
FIG. 42(C)
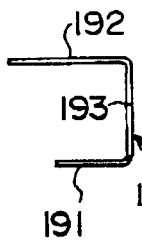
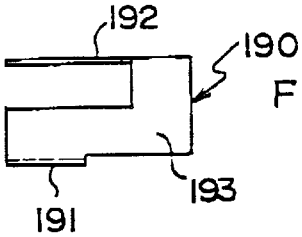
FIG. 42(A)
FIG. 42(D)
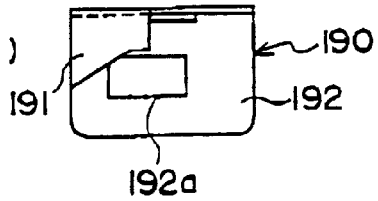
FIG. 43(B)
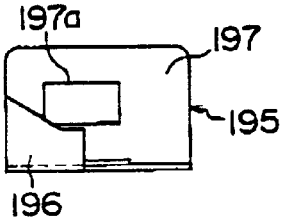
FIG. 43(C)
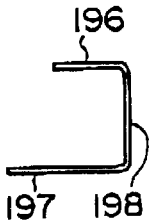
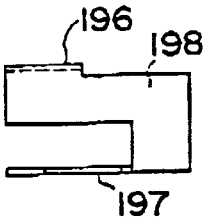
FIG. 43(A)
FIG. 43(D)
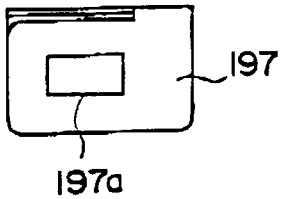

CARTRIDGE FOR HOUSING CONNECTED CLIP BODY OF CLIP MEMBERS

BACKGROUND OF THE INVENTION

1. Field of the Invention

The present invention relates to a cartridge that houses clip members such as clip plates and clip needles which clip the end portion of a sheet bundle.

2. Description of the Related Art

Electric staplers are known as a device for stapling the end portion of a sheet bundle. Instead of the electric staplers there has been proposed a clipping unit which folds a flat clip plate to clip the end portion of a sheet bundle.

Such a clipping unit is equipped with a unit main body having clamp means for folding a flat clip plate, a cartridge detachably attached to the unit main body, and a slider for feeding the flat clip plate housed in the cartridge to the clamp means.

Each time the slider reciprocates, the clip plate is sent out of the cartridge, and it is fed to the clamp means by the slider. The clip plate fed by the slider is folded by the clamp means and clips the end portion of a sheet bundle.

To house a great number of clip plates into the cartridge, they are interconnected in ribbon form by tape and are formed into a connected clip body wound in roll form. When the connected clip body is housed into the cartridge, there is the fear that the housing of the connected clip body or the handling of the leading clip plate of the connected clip body will require time and labor.

SUMMARY OF THE INVENTION

It is an object of the present invention to provide a cartridge in which both the housing of a connected clip body wound in roll form into the cartridge and the handling of the leading clip plate can easily be performed.

To achieve this object, a cartridge according to the present invention is detachably attached to the main body of a unit. The main body of the unit houses a connected clip body where a plurality of clip plates are interconnected in ribbon form by tape and wound in roll form, and the main body is equipped with means for feeding a leading clip plate of the connected clip body to a clipping position and means for folding the clip plate fed to the clipping position and clipping an end portion of a sheet bundle. The cartridge has a main body, which is in turn formed with a chamber for housing the connected clip body and a conveyer path for feeding a clip plate of the connected clip body housed in the housing chamber to the clipping position by the feed means. The housing chamber is provided with an opening at its side wall which becomes an inlet between the housing chamber and the conveyer path. The opening has nearly the same diameter as the diameter of the housing chamber. The main body of the cartridge is provided with a cover for opening or closing the opening. The inlet of the conveyer path is faced to the opening so that the leading clip plate of the connected clip body can easily be inserted into the conveyer path when the connected clip body is housed into the housing chamber.

The above and other objects and advantages of the present invention will become apparent from the following detailed description of the preferred embodiments of the invention when read in conjunction with the accompanying drawings.

BRIEF DESCRIPTION OF THE DRAWINGS

FIG. 41(A) is a front view showing the forward-feed pawl plate of FIG. 39;

FIG. 41(B) is a top view showing the forward-feed pawl plate;

FIG. 41(C) is a side view showing the forward pawl plate;

FIG. 42(A) is a front view showing the upper backward-feed pawl plate of FIG. 39;

FIG. 42(B) is a top view showing the upper backward-feed pawl plate;

FIG. 42(C) is a side view showing the upper backward-feed pawl plate;

FIG. 42(D) is a bottom view showing the upper backward-feed pawl plate;

FIG. 43(A) is a front view showing the lower backward-feed pawl plate of FIG. 39;

FIG. 43(B) is a top view showing the lower backward-feed pawl plate;

FIG. 43(C) is a side view showing the lower backward-feed pawl plate;

FIG. 43(D) is a bottom view showing the lower backward-feed pawl plate;

DETAILED DESCRIPTION OF THE PREFERRED EMBODIMENTS

Figure 1:
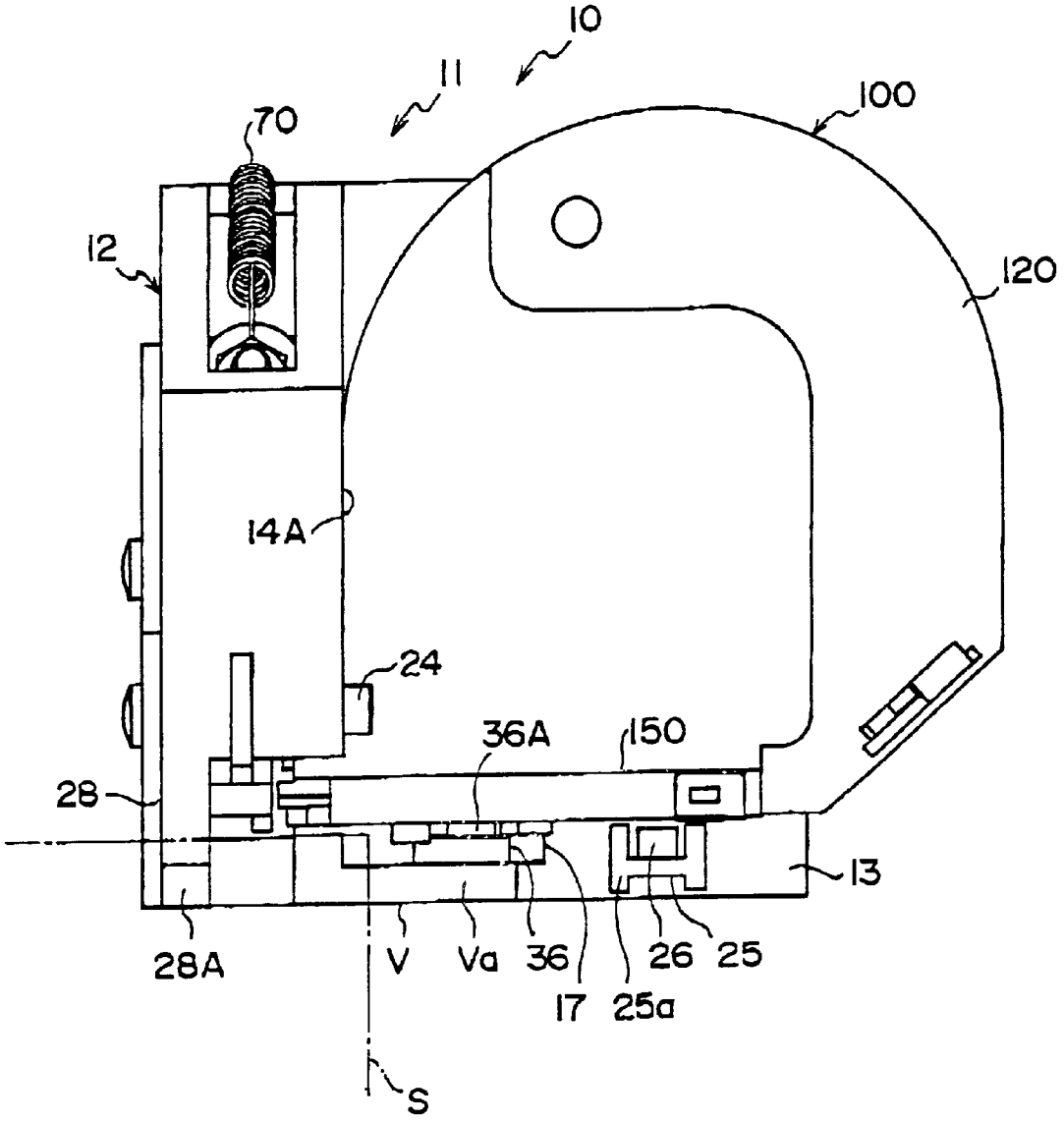
FIG. 1 is a plan view showing a clipping unit according to the present invention.

An embodiment of a cartridge according to the present invention will hereinafter be described in detail in reference to the drawings.

In FIGS. 1 through 4, reference numeral 10 denotes a clipping unit which is attached, for example, to a copying machine. The clipping unit 10 is constituted by a main body 11 and a cartridge 100 detachably attached to the main body 11.

The housing 12 of the main body 11 is provided with a slider reciprocating mechanism 30 for laterally reciprocating a slider (feed means) 150 attached to the cartridge 100, a clamping mechanism (clipping means) 50 for folding a clip plate 101, and a drive mechanism 80 for driving the slider reciprocating mechanism 30 and the clamping mechanism 50.

(Housing)

The housing 12 is provided with a table 13 for placing the cartridge 100, as shown in FIGS. 5 through 10. By the side of the table 13 a clamp chamber 14 is formed, and the clamping mechanism 60 is provided in the clamp chamber 14. Also, the housing 12 is formed with a gear chamber 15 under the table 13 and a cam chamber 16 under the clamp chamber 14.

Figure 5:
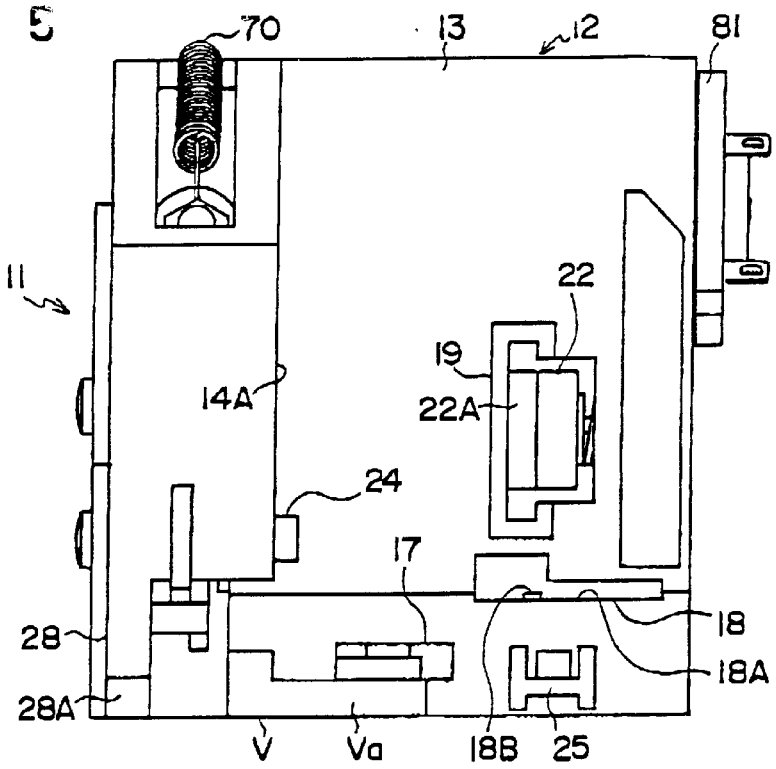
FIG. 5 is a top view showing the unit main body.
Figure 6:
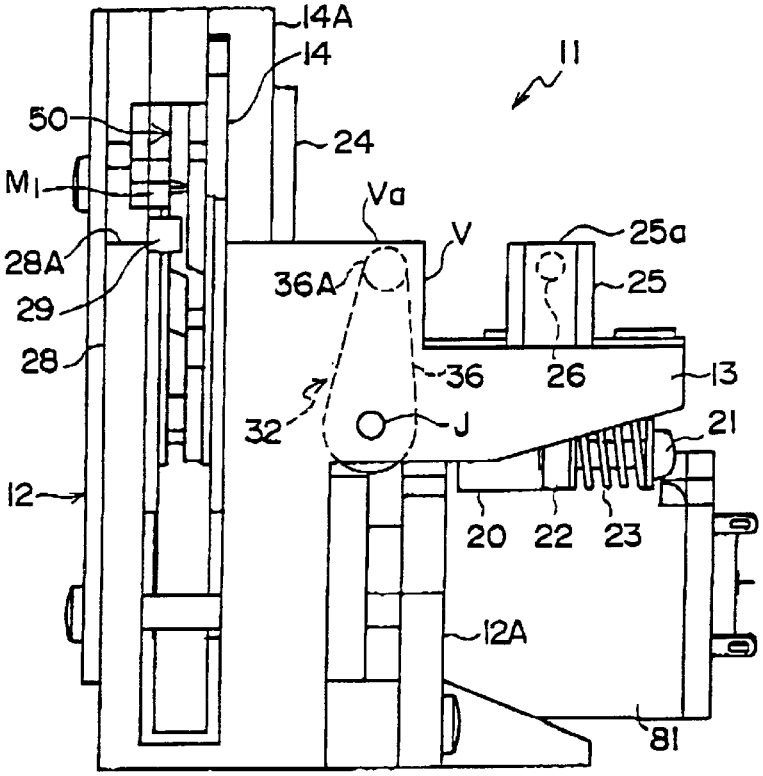
FIG. 6 is a front view showing the unit main body.
Figure 7B:
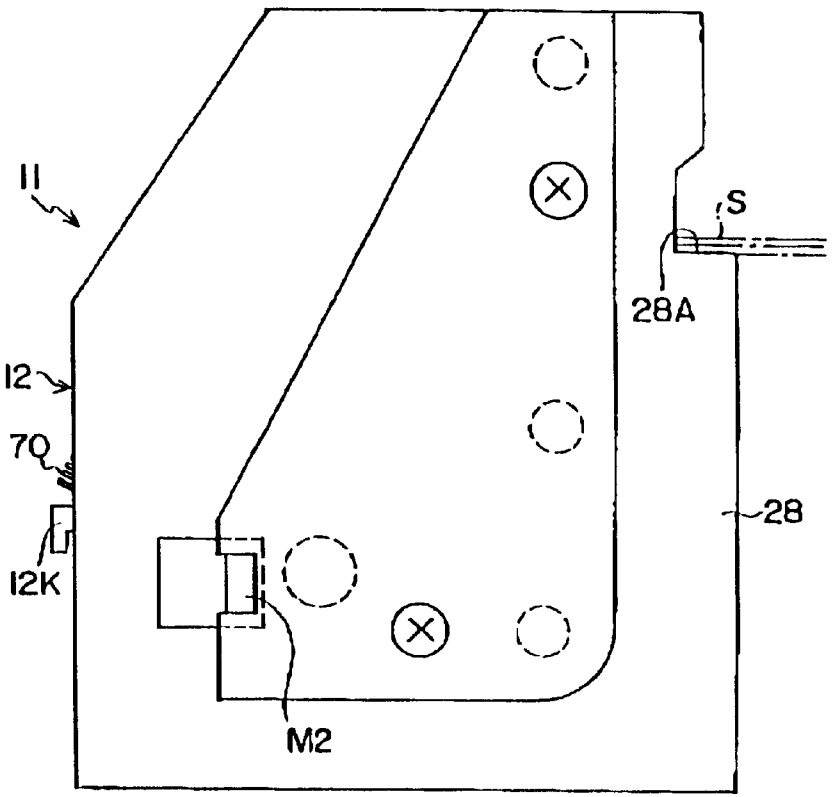
FIG. 7(B) is a right side view showing the unit main body.
Figure 7A:
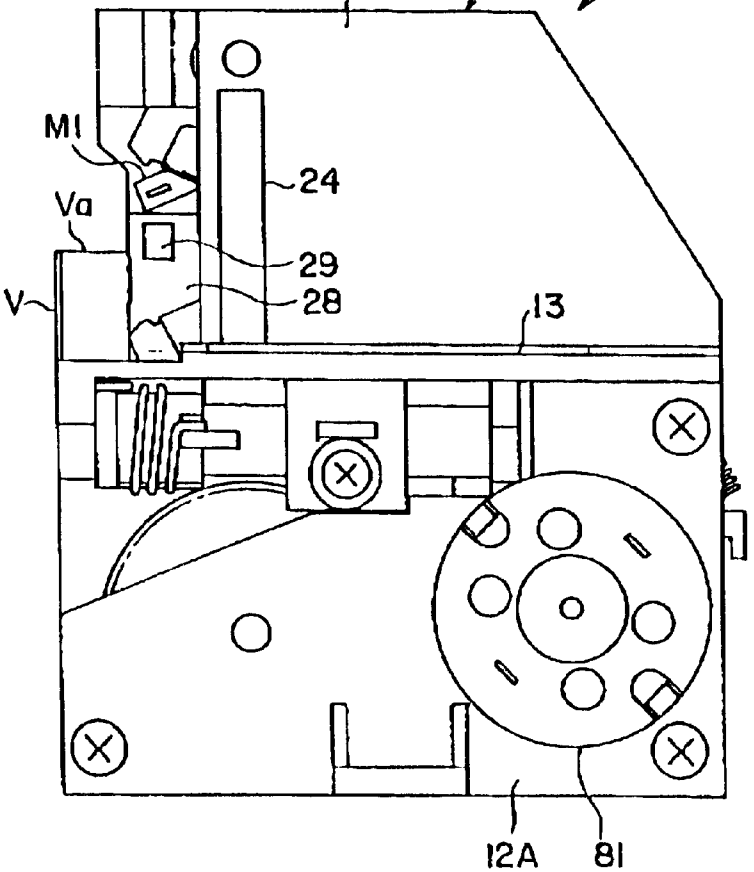
FIG. 7(A) is a left side view showing the unit main body.
Figure 8:
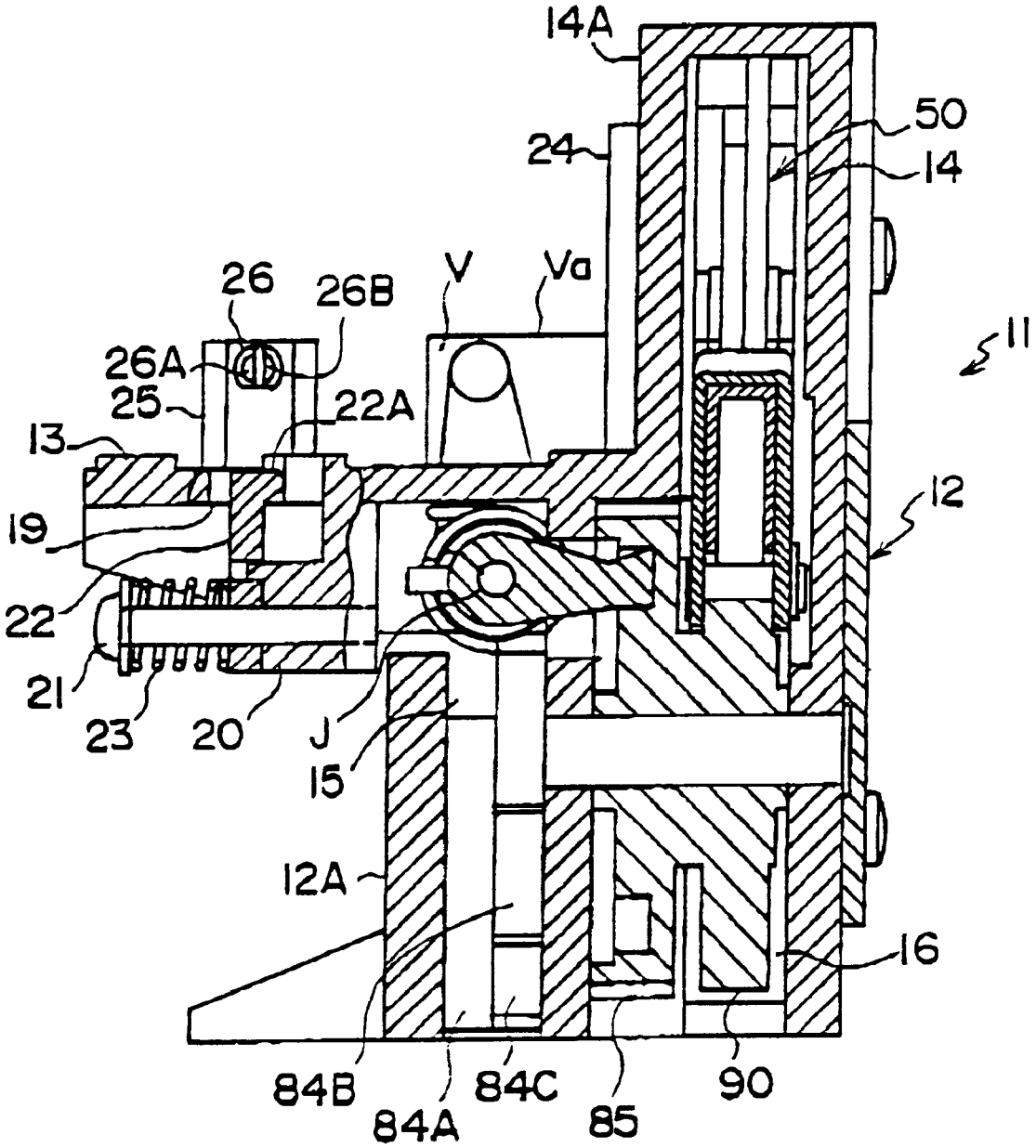
FIG. 8 is a vertical sectional view showing the unit main body.

The table 13 in FIG. 5 is provided with a rectangular arm hole 17 extending right and left, an unlock hole 18 extending right and left, and a stopper hole 19 extending in a direction perpendicular to the unlock hole 18. The unlock hole 18 has a large-width portion and a small-width portion, and the stopper hole 19 has a large-width portion at its intermediate portion.

The side surface 18A of the unlock hole 18 is provided with a protrusion 18B, which in turn has an inclined surface 18*b* (FIG. 26) which protrudes as it extends downward.

The lower surface of the table 13 is provided with a cartridge holding portion 20 into which a screw 21 is fitted. A stopper piece 22 is attached to the screw 21 so that it can move on and along the screw 20. The stopper piece 22 is urged in a right direction (in FIGS. 3 and 8) by a spring 23 attached to the screw 21.

The stopper piece 22 is formed with an upper stopper portion 22A protruding left (in FIG. 5), and the upper stopper portion 22A is inserted into the stopper hole 19. Between the upper stopper portion 22A and the stopper hole 19 in a lateral direction (in FIGS. 3, 5, and 8), a predetermined gap is formed.

On the upper surface of the table 13 a guide rail 24 is formed, and the guide rail 24 extends in a vertical direction along a side wall 14A forming the clamp chamber 14. Also, the upper surface of the table 13 is provided with an upwardly protruding support member 25 at the front side. The support member 25 is provided with a sensor 26 (FIG. 8) consisting of light-emitting diodes (LEDs) 26A and 26B.

Figure 22:
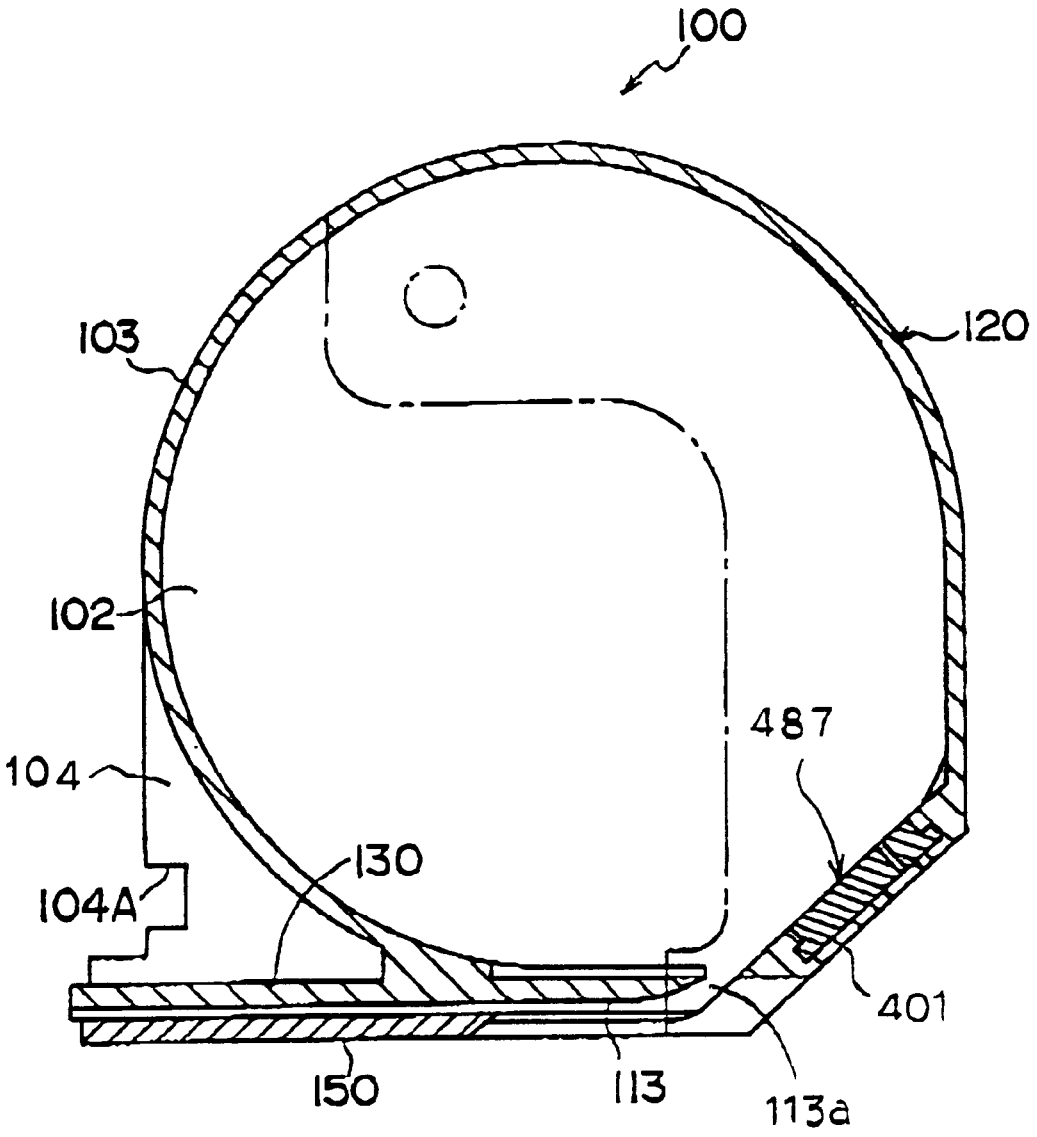
FIG. 22 is a horizontal sectional view showing the cartridge.

In the sensor 26, the light emitted by the LED 26A is reflected by the tape 201 of a connected clip body 200 provided in the conveyer path 113 of the cartridge 100 to be described later, and the reflected light is received by the LED 26B, thereby detecting the presence of a clip plate 101 (see FIGS. 2 and 22). Since the presence of the clip plate 101 is detected by the reflected light from the table 201, the presence of the clip plate 101 can reliably be detected. On the other hand, in the case where the clip plate 101 is detected by the reflected light from the clip plate 101, when there is a gap between adjacent clip plates 101, the sensor 26 cannot receive reflected light from the clip plate 101 and cannot detect the clip plate 101.

The table 13 has a front wall portion V at its front end, and the front end of the side wall 28 of the housing 12 is formed with a stepped portion 28A for placing a bundle of sheets S thereon. The upper surface Va of the front wall portion V, the stepped portion 28, and the upper surface 25*a* of the support member 25 are on the same level with one another for placing the sheet bundle S.

A stopper 29 for stopping the clip plate 101 fed by the slider 150 at a predetermined position and a first microswitch M1 for detecting that the clip plate 101 has been fed to the predetermined position are provided inside the exterior wall 28 of the housing 12. Reference numeral M2 denotes a second microswitch, which detects whether or not a link-member drive cam 85 (to be described later) has returned to its initial position (home position). The second microswitch M2 detects that the link-member drive cam 85 has returned to the initial position (home position), by detecting a recess 90A provided in the side portion of a clamp-member drive cam 90 to be described later.

(Drive Mechanism)

The drive mechanism 80 is equipped with a drive motor 81 attached to the side wall 12A of the housing 12, a gear 83 provided on the drive shaft 82 of the drive motor 81, a speed reduction gear train 84 with speed reduction gears 84A through 84D engaging the gear 83, and a link-member drive cam 85 engaging the speed reduction gear 84D of the speed reduction gear train 84. The gear 83 and the gears 84A through 84D are disposed in the gear chamber 15 of the housing 12, and the link-member drive cam 85 is disposed in the cam chamber 16.

Figure 9:
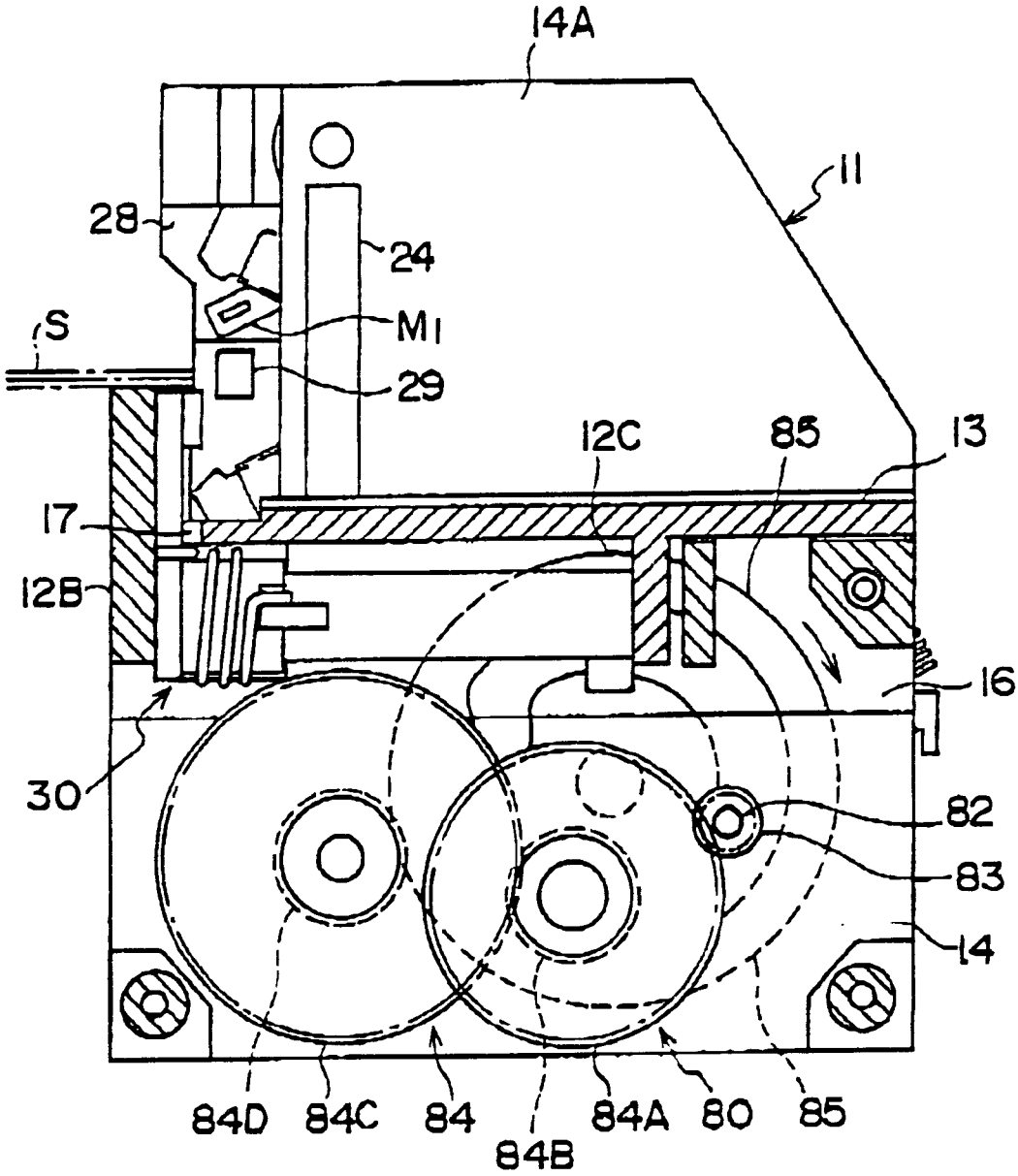
FIG. 9 is a cutaway view showing the drive mechanism of the unit main body.
Figure 10:
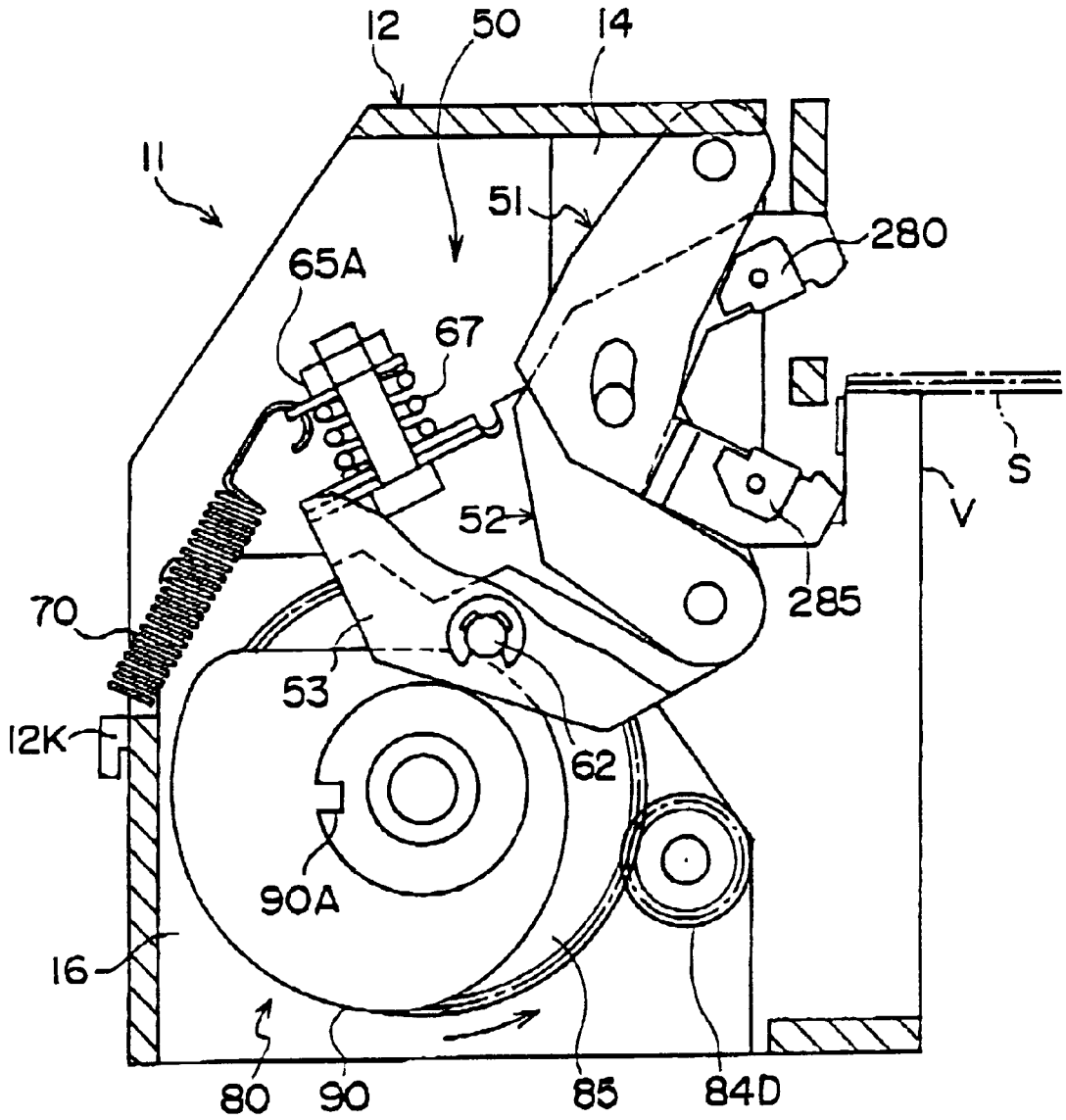
FIG. 10 is a cutaway view showing the clamp mechanism of the unit main body.

The link-member drive cam 85 is rotated in a direction of the arrow shown in FIG. 9 through the gear 83 and the gears 84A through 84D by the drive motor 81.

Figure 11:
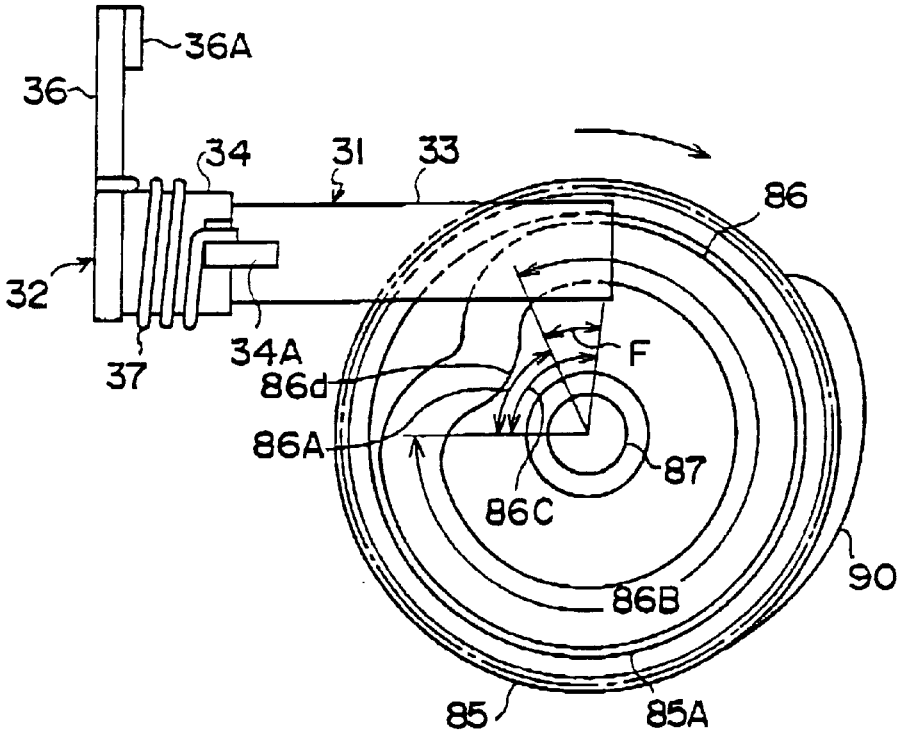
FIG. 11 is a side view showing the slider reciprocating mechanism of the unit main body.

One side surface 85A of the link-member drive cam 85, as shown in FIG. 11, has an annular cam groove 86, which in turn has a small-diameter portion 86A where the distance from center of a rotational shaft 37 is reduced and a large-diameter portion 86B where the distance from that center is constant.

Also, the link-member drive cam 85 is integrally provided with a clamp-member drive cam 90 which rotates with the link-member drive cam 85.

Figure 14:
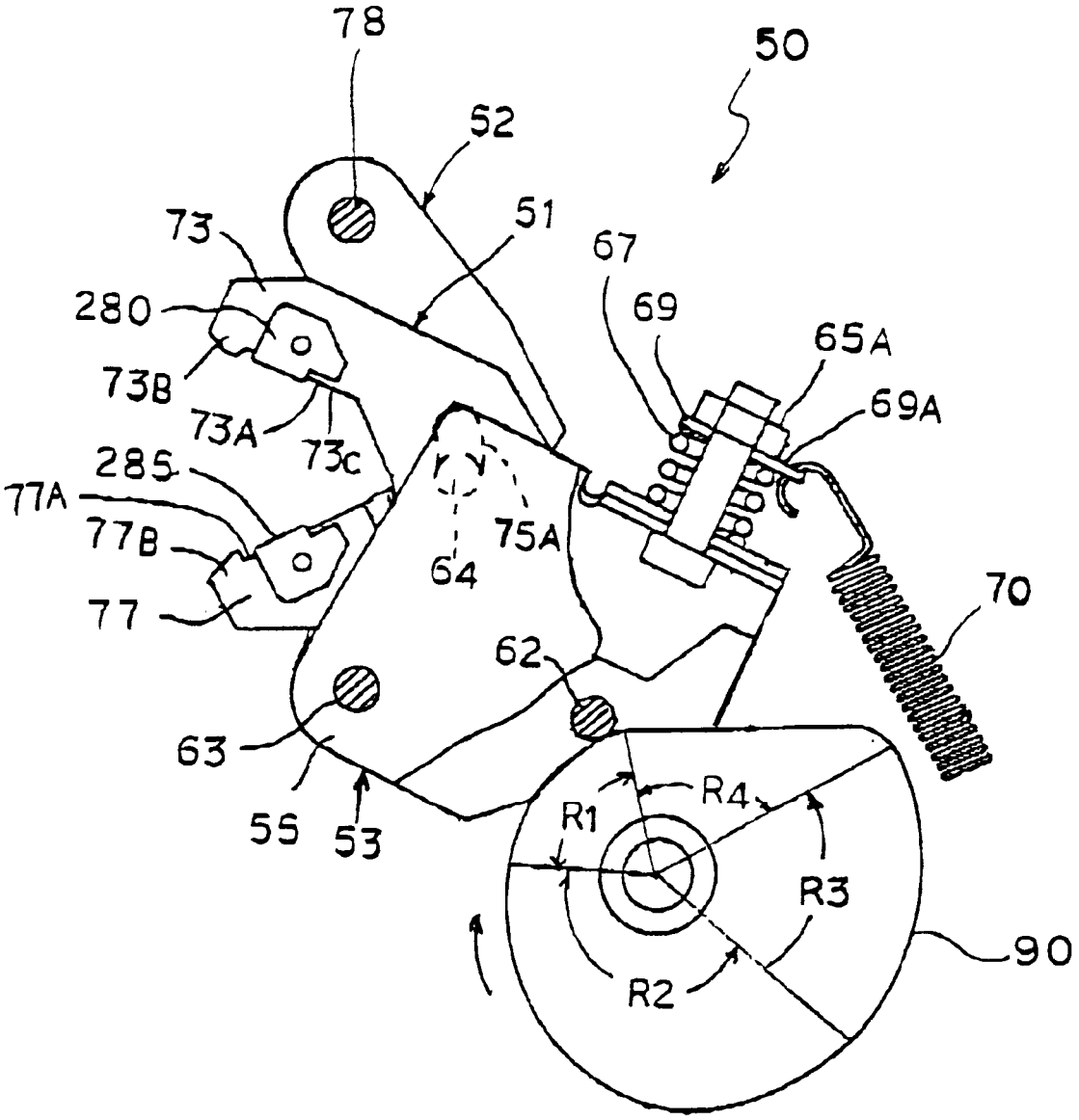
FIG. 14 is a schematic view showing the clamp mechanism of the unit main body.

The clamp-member drive cam 90, as shown in FIG. 14, consists of a small-diameter portion R1 whose diameter is minimum, an increasing portion R2 whose diameter increases gradually, a large-diameter portion R3 whose diameter is maximum, and a reducing portion R4 whose diameter reduces gradually. The small-portion R1 of the clamp-member drive cam 90 nearly corresponds to a portion 86C (FIG. 11) which includes the home position F and small-diameter portion 86A of the cam groove 86, while the increasing portion R2 of the clamp-member drive cam 90 partially overlaps with the small-diameter portion 86A of the cam groove 86.

(Slider Reciprocating Mechanism)

The slider reciprocating mechanism 30 is constituted by first and second link members 31 and 32 freely rotatably attached to a shaft J provided in the support portions 12B and 12C of the housing 12.

Figure 12:
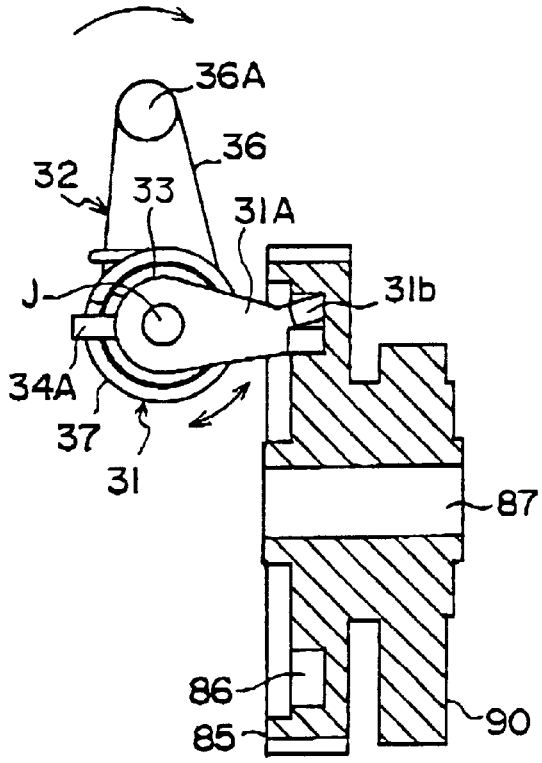
FIG. 12 is a front view showing the slider reciprocating mechanism of the unit main body.
Figure 13:
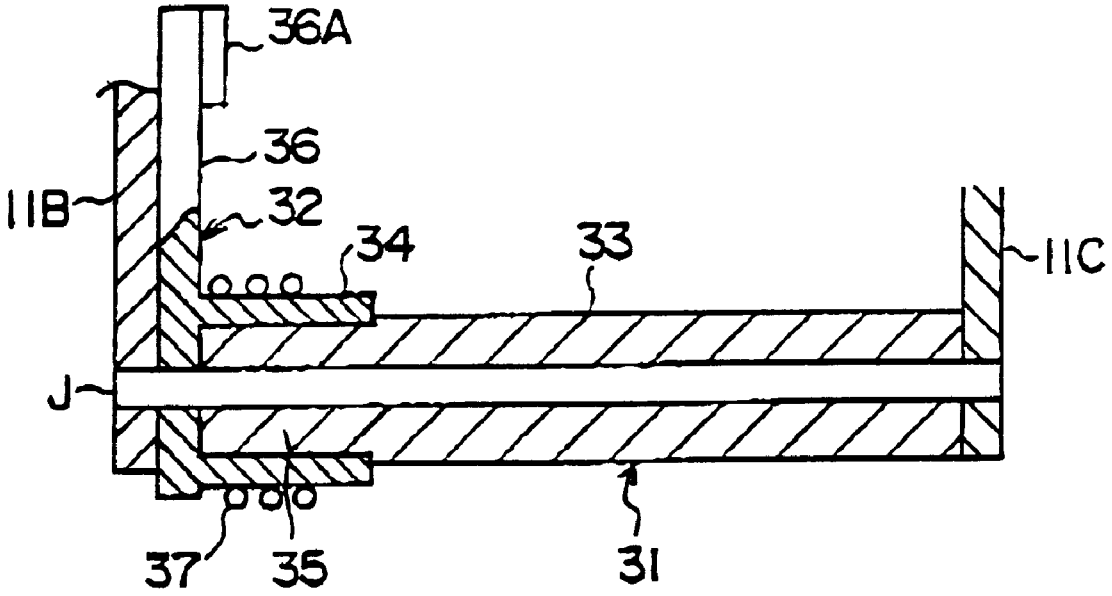
FIG. 13 is a sectional view showing the link members of FIG. 11.

The first link member 31 is formed from an outer axial portion 33 and an inner axial portion 35 extending from the outer axial portion 33, as shown in FIG. 13. The outer axial portion 33 has an arm portion 31A (FIG. 12), and the point end portion 31*b* of the arm portion 31A is inserted into the cam groove 86 of the link-member drive cam 85. If the clamp-member drive cam 90 is rotated, then the point end portion 31*b* of the arm portion 31A will be moved up and down by the cam groove 86, and consequently, the first link member 31 will be rotated on the shaft J, as shown by an arrow in FIG. 12.

The second link member 32 is constituted by a cylindrical portion 34 and an arm portion 36 extending upward from the cylindrical portion 34. The cylindrical portion 34 is fitted onto the axial portion 35 of the first link member 31 so that it is freely rotatable. The upper end of the arm portion 36 is provided with a stopper protrusion 36A. The first link member 31 is rotatable by only a predetermined amount with respect to the second link member 32.

A coil spring 37 is fitted on the cylindrical portion 35 of the second link member 32. One end of the coil spring 37 is connected to a stopper portion 34A provided on the first link member 31, while the other end is connected to the arm portion 36 of the second link member 32. The second link member 32 is rotated with the first link member 31 by the coil spring 37, and if rotation of the first link member 31 is stopped, only the first link member 31 will rotate with respect to the second link member 32.

Figure 2:
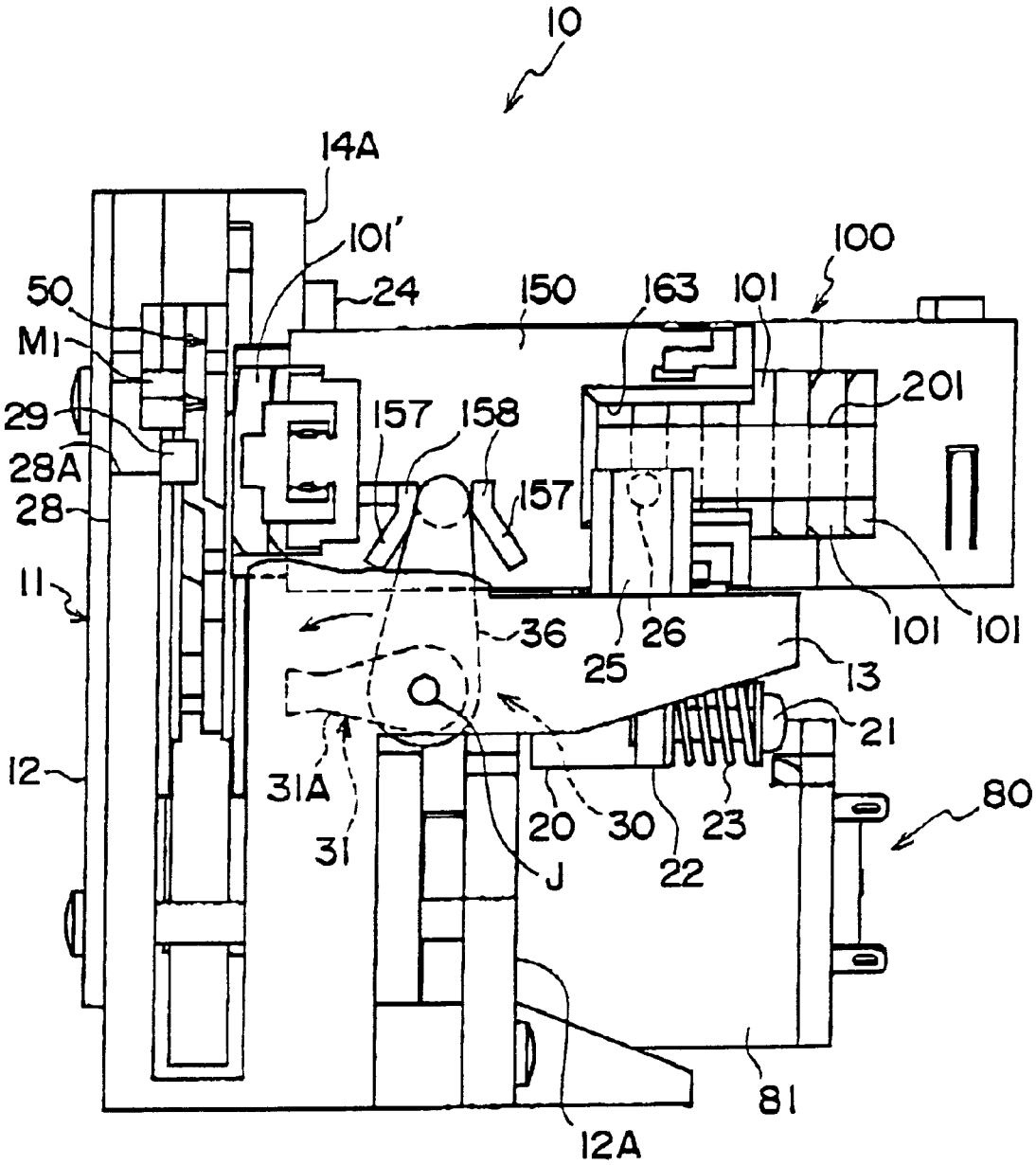
FIG. 2 is a front view of the clipping unit shown in FIG. 1.
Figure 3:
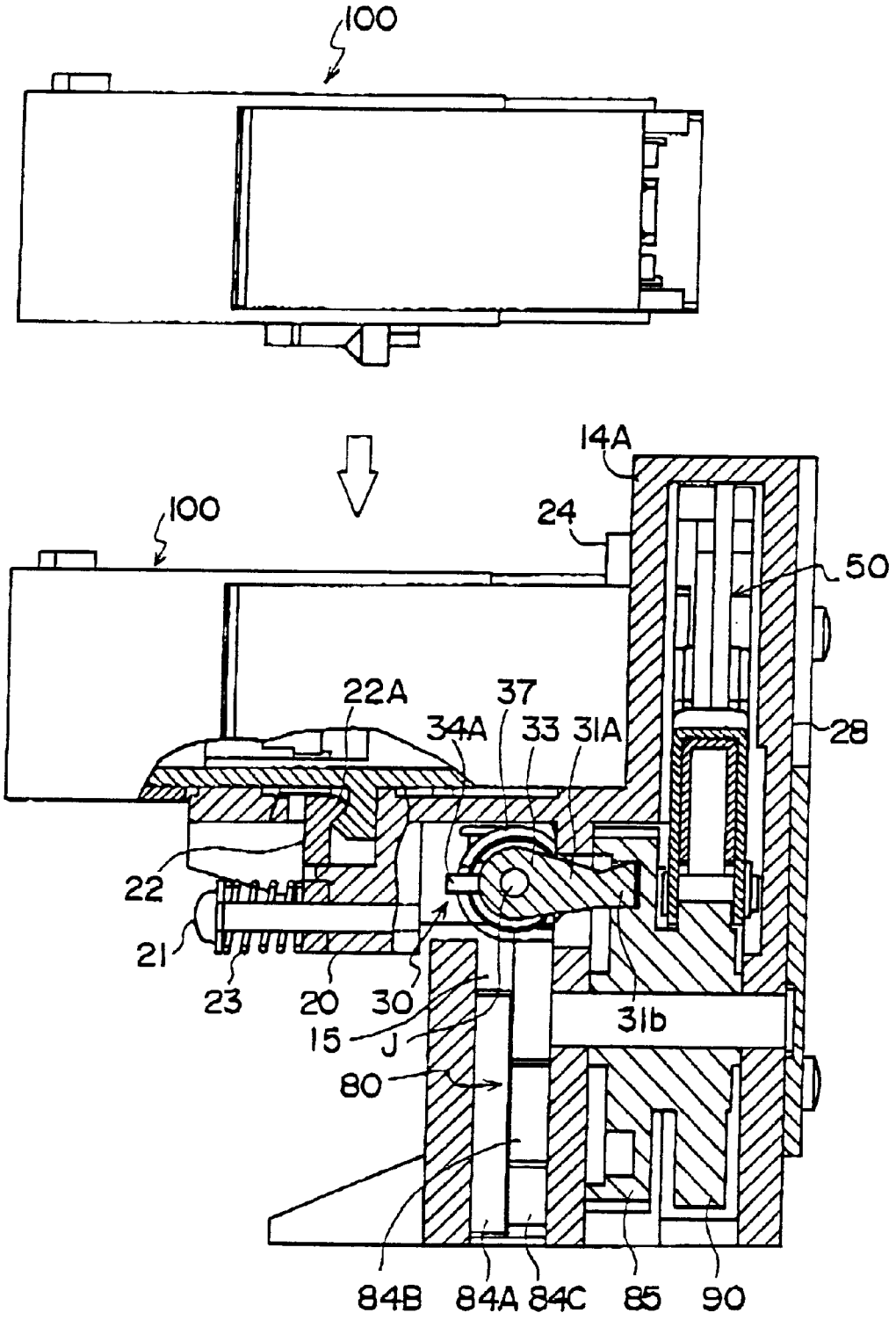
FIG. 3 is a vertical sectional view showing the main body of the clipping unit in FIG. 1.
Figure 4:
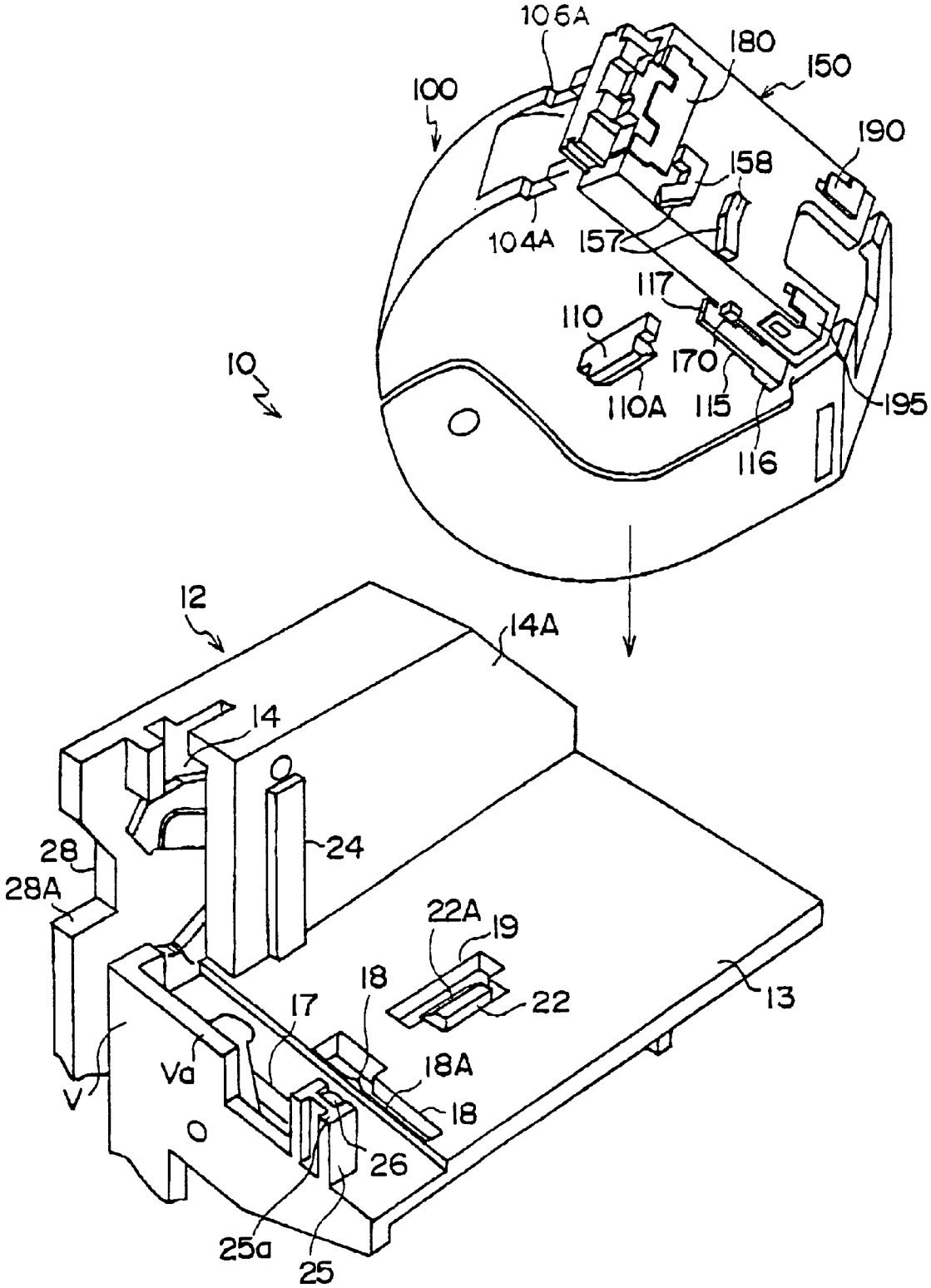
FIG. 4 is a perspective view showing the unit main body and the cartridge of FIG. 1.

With the rotation of the second link member 32, the arm portion 36 is rotated, thereby reciprocating the slider 150 in a lateral direction of FIG. 2.

(Clamping mechanism)

Figure 15:
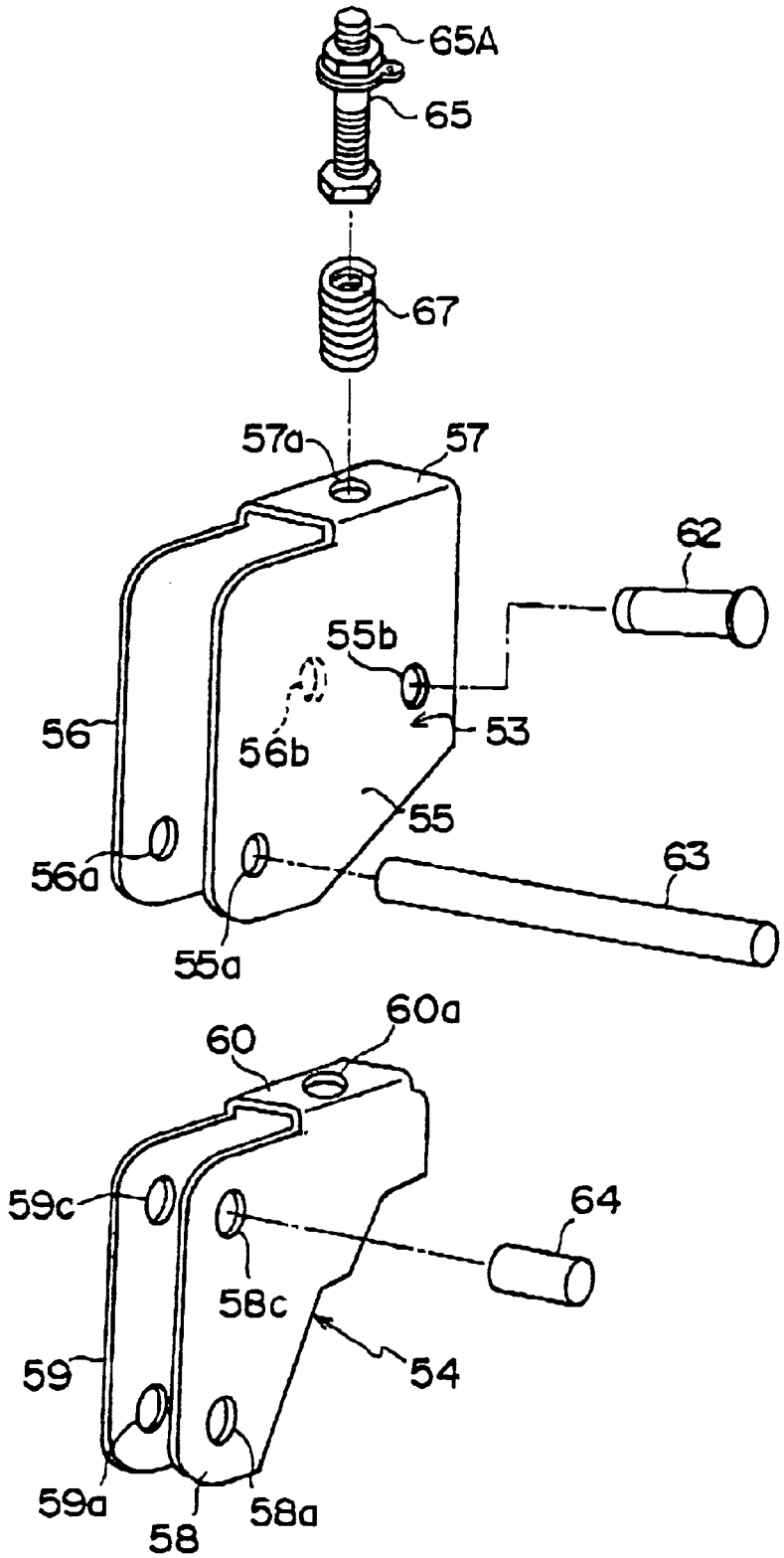
FIG. 15 is an exploded perspective view showing the clamp rotating members of FIG. 14.
Figure 16:
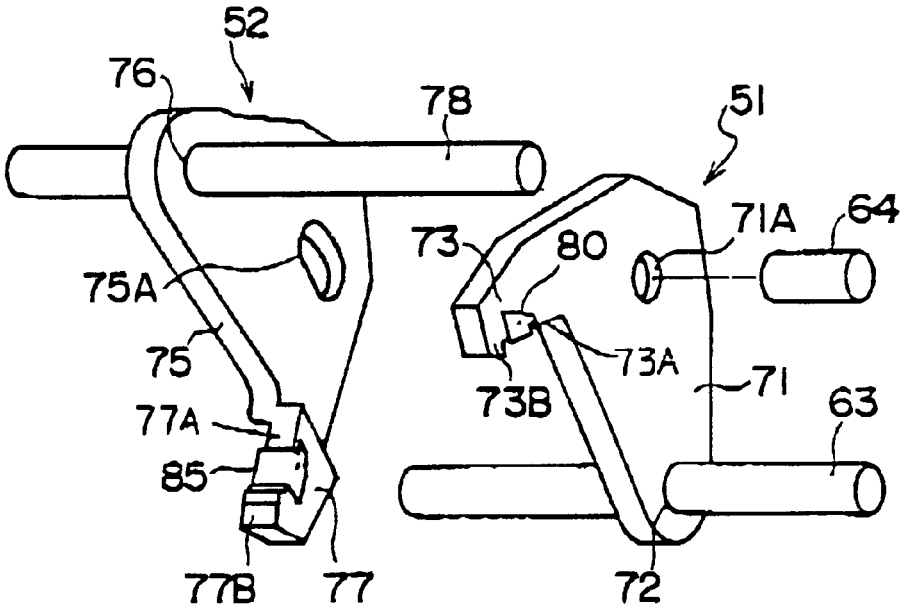
FIG. 16 is a perspective view showing the upper and lower clamp members of FIG. 14.

The clamping mechanism 50 is equipped with a pair of clamp members (clip means) 51 and 52, two clamp rotating members 53 and 54 interposing the clamp members 51 and 52 therebetween, and an actuator shaft 62 attached to the first clamp rotating member 53 and abutting the circumferential surface of the clamp-member drive cam 90, as shown in FIGS. 14 through 16.

(Clamp Rotating Member)

The first clamp rotating member 53 is constituted by a pair of opposed side plate portion 55 and 56 and a connection plate portion 57 connecting the upper portions of the side plates portions 55 and 56 (FIG. 15) together. The front lower portions of the side plate portions 55 and 56 are formed with opposed holes 55*a* and 56*a*, respectively. Likewise, the rear upper portions of the side plate portions 55 and 56 are formed with opposed holes 55*b* and 56*b*. Furthermore, the connecting plate portion 57 is formed with a screw hole 57*a*.

A shaft 63 is inserted into the holes 55*a* and 56*a* of the side plate portions 55 and 56 and is attached to the side was 14A and 28 forming the clamp chamber 14 of the housing 12. The first clamp rotating member 53 is rotatable on the shaft 63. The actuator shaft 62 which is a cam follower are inserted into the holes 55*b* and 56*b* of the side plate portions 55 and 56 so that it is freely rotatable.

The second clamp rotating member 54 is interposed between the side plate portions 55 and 56 of the first clamp rotating member 53.

The second clamp rotating member 54 is constituted by a pair of opposed side plate portion 58 and 59 and a connection plate portion 60 connecting the upper portions of the side plates portions 58 and 59 together.

The front lower portions of the side plate portions 58 and 59 of the second clamp rotating member 54 are formed with opposed holes 58*a* and 59*a*, respectively. Likewise, the front upper portions of the side plate portions 58 and 59 are formed with opposed holes 58*c* and 59*c*. Furthermore, the connecting plate portion 60 is formed with a screw hole 60*a*.

The holes 55*a* and 56*a* of the side plate portions 55 and 56 of the first clamp rotating member 53 are axially aligned with the holes 58*a* and 59*a* of the side plate portions 58 and 59 of the second clamp rotating member 54. The screw hole 57*a* of the connecting plate portion 57 of the first clamp rotating member 53 is vertically aligned with the screw hole 60*a* of the connecting plate portion 60 of the second clamp rotating member 54.

Therefore, the shaft 63, inserted into the holes 55*a* and 56*a* of the side plate portions 55 and 56 of the first clamp rotating member 53, is also inserted into the holes 58*a* and 59*a* of the side plate portions 58 and 59 of the second clamp rotating member 54.

A screw 65 is fitted into the hole 57*a* of the connecting plate portion 57 of the first clamp rotating member 53 and the hole 60*a* of the connecting plate portion 60 of the second clamp rotating member 54, and a nut 65A is fitted on the upper portion of the screw through a spring 67. The connecting plate portions 57 and 60 of the clamp rotating members 53 and 54 are urged by the spring 67 in a direction where they approach each other, and the clip rotating members 53 and 54 are integrally rotated on the shaft 63. Reference numeral 69 denotes a washer, which is interposed between the spring 67 and the nut 65A. One end of a spring 70 is connected to the stopper hole 69*a* of the washer 69, while the other end is connected to the stopper portion 12K of the housing 12.

The first clamp rotating member 53 is movable against the urging force of the spring 67 and is rotatable by only a predetermined angle on the shaft 63 with respect to the second clamp rotating member 54, and rotation of the clamp-member drive cam 90 is smoothly performed regardless of the thickness of a sheet bundle S.

The clamp rotating members 53 and 54 are urged on the shaft 63 in a clockwise direction of FIG. 14 by the spring 70 so that the actuator shaft 62 of the first clamp rotating member 53 can abut the circumferential surface of the clamp-member drive cam 90 at all times.

Between the side plate portions 58 and 59 of the second clamp rotating member 54, the clamp members 51 and 52 are interposed.

(Clamp Member)

The upper clamp member 51, as shown in FIG. 16, is constituted by a flat arm portion 71 and a clamp portion 73 protruding forward from the upper portion of the arm portion 71. The arm portion 71 is provided with a shaft hole 72 at the lower portion and a hole 71A at the rear upper portion. The clamp portion 73 is provided with a protrusion 73B protruding downward from the front end of the lower surface 73A of the clamp portion 73.

Figure 17:
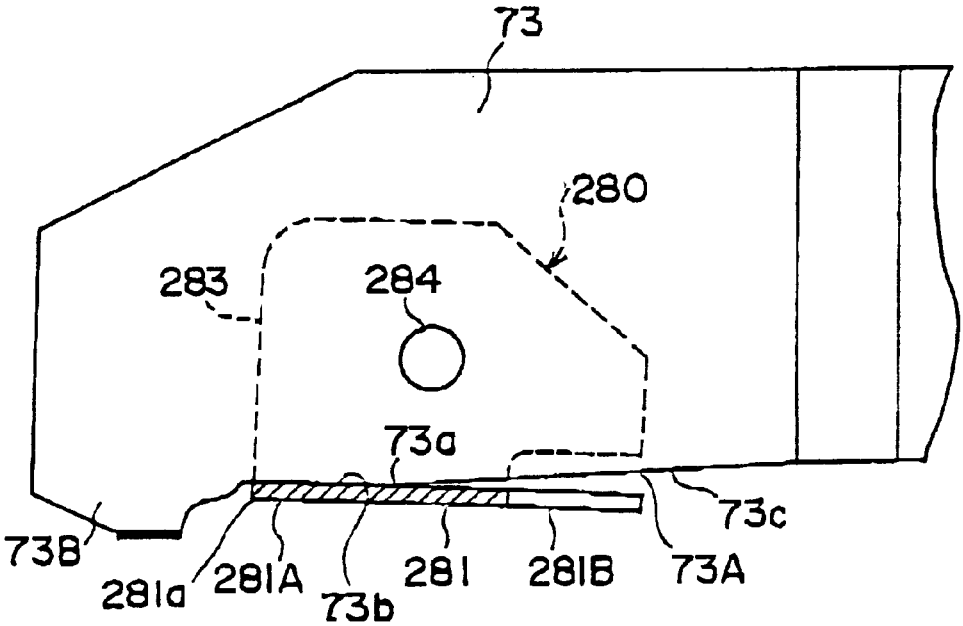
FIG. 17 is an enlarged side view showing the clamp portion of the clamp member of FIG. 16, a press member being attached to the clamp portion.
Figure 19:
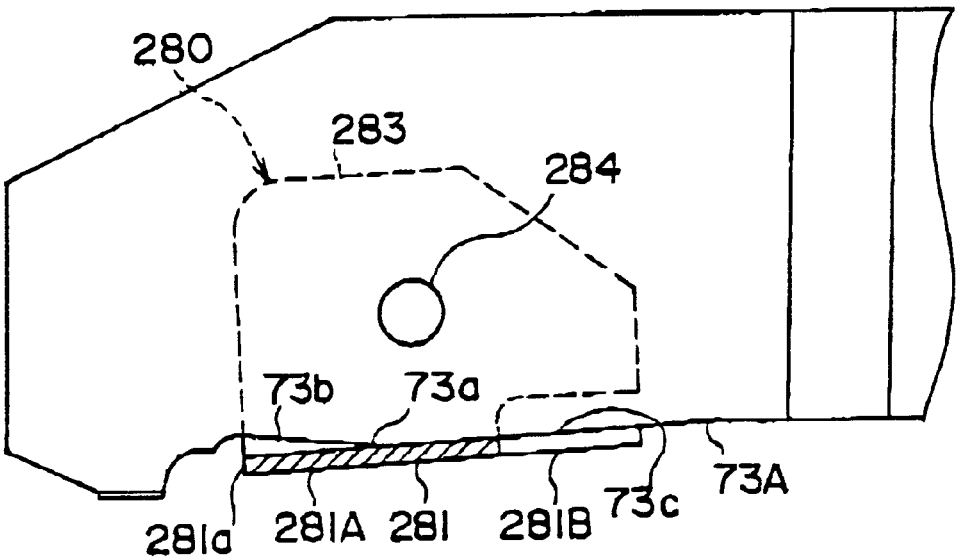
FIG. 19 is an enlarged side view showing the clamp portion of the clamp member, the press member being rotated from the position shown in FIG. 16.
Figure 20:
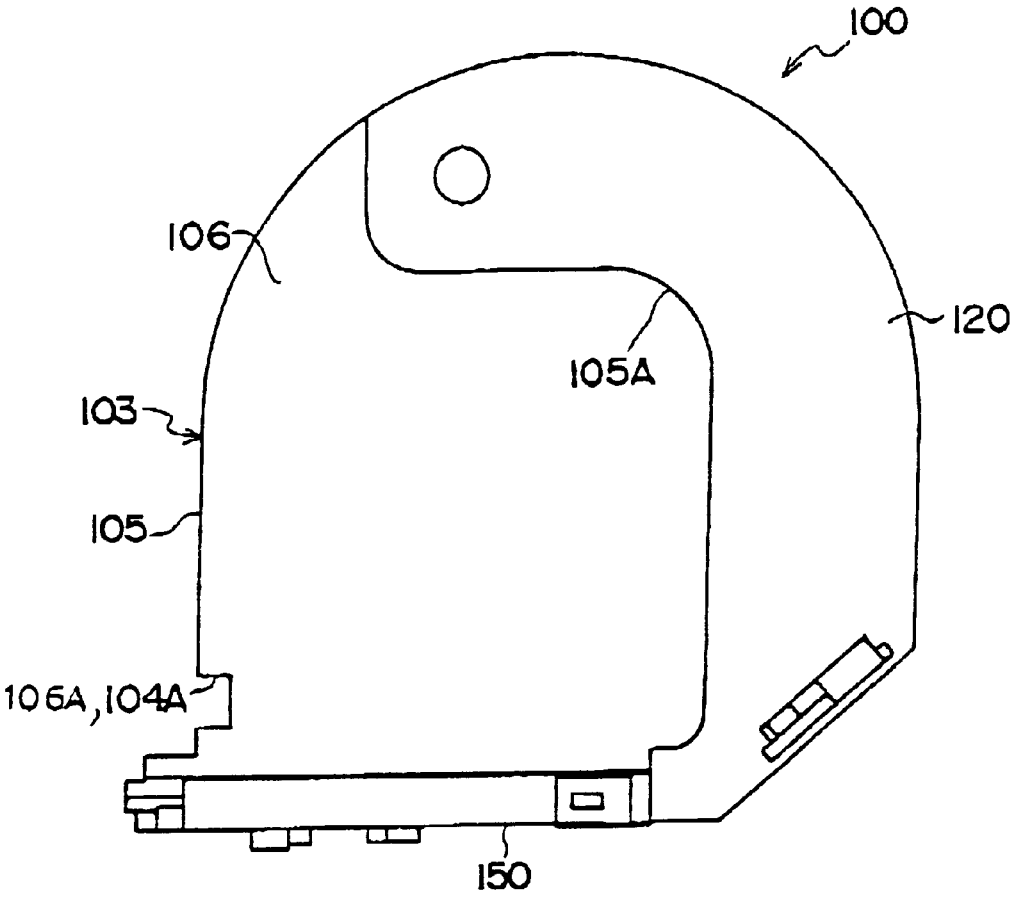
FIG. 20 is a top view showing the cartridge according to the present invention.
Figure 21:
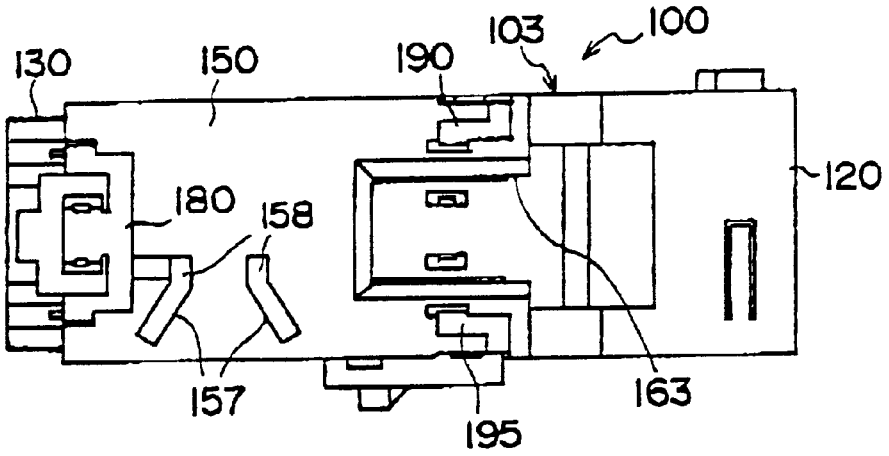
FIG. 21 is a front view showing the cartridge.

The lower surface 73A of the clamp portion 73, as shown in FIGS. 17 and 19, is constituted by a front inclined surface 73*b* extending from a vertex 73*a* and a rear inclined surface 73*c* extending from the vertex 73*a*.

Figure 18:
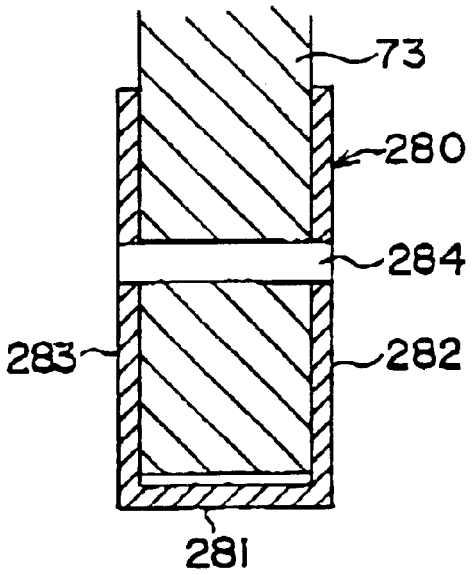
FIG. 18 is a sectional view showing the press member attached to the clamp member.

As shown in FIGS. 17 through 19, a generally U-shaped press member 280 is attached to the clamp portion 73 of the upper clamp member 51. The press member 280 is constituted by a flat press portion 281 and flat attaching pieces 282 and 283 extending from both sides of the press portion 281. The press member 280 is attached to the clamp portion 73 of the upper clamp member 51 by means of a pin 284 inserted into the attaching pieces 282 and 283 and into the clamp portion 73. As shown in FIGS. 17 and 19, the press member 281 is rotatable on the pin 284 so that the front portion 281A of the press member 281 can abut the front inclined surface 73*b* of the clamp portion 73 and also the rear portion 281B of the press member 281 can abut the rear inclined surface 73*c* of the clamp portion 73.

If the rear portion 281B of the press portion 281 abuts the rear inclined portion 73*c* of the clamp portion 73, then the front end portion 281*a* of the press portion 281 will protrude downward.

The shaft 63 inserted into the clamp rotating members 53 and 54 is inserted into the shaft hole 72 of the upper clamp member 51, and the shaft 64 attached to the second clamp rotating member 54 is fitted into the hole 71A of the upper clamp member 51. Therefore, the upper clamp member 51 is rotatable on the shaft 63 along with the clamp rotating members 53 and 54.

The lower clamp member 52, as shown in FIG. 16, is constituted by a flat arm portion 75 and a clamp portion 77 protruding forward from the lower portion of the arm portion 75. The arm portion 75 is opposed to the arm portion 71 of the upper clamp member 51. The arm portion 75 is provided with a shaft hole 76 at the upper portion and an elongated hole 75A at the intermediate portion.

A shaft 78 provided in the housing 12 is inserted into the shaft hole 76 of the arm portion 75, and the lower clamp member 52 is rotatable on the shaft 78. The shaft 64 attached to the clamp member 54 is inserted into the elongated hole 75A of the arm portion 75 and is movable along the elongated hole 75A. The elongated hole 75 is formed into a shape which allows the clamp members 51 and 52 to move relatively with each other.

Therefore, if the upper clamp member 51 is rotated on the shaft 63 in a counterclockwise direction (in FIG. 14) along with the clamp rotating members 53 and 54, then the lower clamp member 52 will be rotated on the shaft 78 in a clockwise direction (in FIG. 14).

The clamp portion 77 of the lower clamp member 52 is opposed to the clamp portion 73 of the upper clamp member 51. The clamp portion 77 is provided with a protrusion 77B protruding upward from the front end of the upper surface 77A of the clamp portion 77. The protrusions 73B and 77B of the clamp members 51 and 52 hold the opposite end portions of the clip member 101 fed by the slider 150.

On the upper surface 77A of the clamp portion 77, a similar vertex (not shown) and inclined surfaces (not shown) are formed in opposition to the vertex 73*a* and inclined surfaces 73*b* and 73*c* of the clamp portion 75 of the upper clamp member 51. Also, the clamp portion 77 is provided with a similar press member 285 as the press member 281. The press member 285 is rotatable on a shaft 286 (see FIG. 45), and the front end portion 287*a* (see FIG. 47) of the press member 285 will protrude upward in the same way as the aforementioned.

If the clamp members 51 and 52 are rotated on the shafts 63 and 78, the clamp portions 73 and 77 will be closed and the clip plate 101 will be folded. The folded portion of the clip plate 101 will be caulked by the clamp members 51 and 52.

The drive motor 81, incidentally, is controlled by a control circuit (not shown). This control circuit controls the drive motor 81, for example, based on a clip signal from the main body of the copying machine or a detection signal from the sensor 26.

(Cartridge)

The cartridge 100, as shown in FIGS. 20 through 25, is constituted by a main body 103 forming a generally circular housing chamber 102 and a lid body 120 attached to the main body 103 so that it can be opened and closed.

The main body 103 of the cartridge 100 is constituted by a circumferential plate 105 provided on the circumference of a bottom plate 104 and a ceiling plate 106 provided on the circumferential plate 105. The circumferential plate 105 is formed with an opening 105A which opens the housing chamber 102 when the lid body 120 is opened. The width of the opening 105A is nearly the same as the diameter of the housing chamber 102 so that a connected clip body 200 (FIG. 44) wound in roll form can easily be housed into the housing chamber 102.

The inlet 113*a* of the convey path 113 faces the opening 105A of the housing chamber 102. Therefore, if the lid body 120 is opened, the leading clip plate 101' (FIG. 44) of the connected clip body 200 can be put from the inlet 113*a* into the conveyer path 113.

The end portions of the bottom plate 104 and the ceiling plate 106 are formed with recesses 104A and 106A (FIG. 4) which engage the guide rail 24 of the main body 11 of the clipping unit 10. The lower surface of the bottom plate 104 is provided with a stopper piece 110 having a protrusion 110A, which is in turn inserted into the stopper hole 19 of the table 13 of the main body 11. If the stopper piece 110 is inserted into the stopper hole 19, then the protrusion 110A of the stopper piece 110 will engage the stopper portion 22A of the stopper piece 22 of the main body 11.

Figure 26:
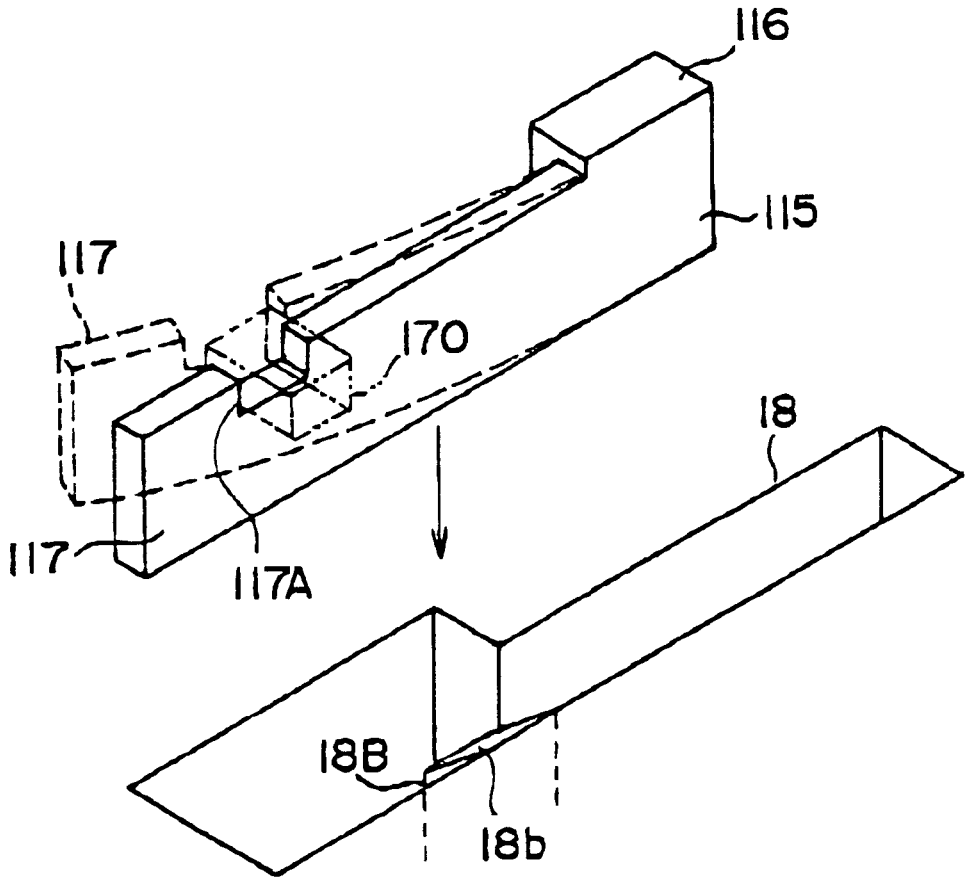
FIG. 26 is a perspective view how the slider attached to the cartridge of FIG. 25 is locked by a lock member.
Figure 27:
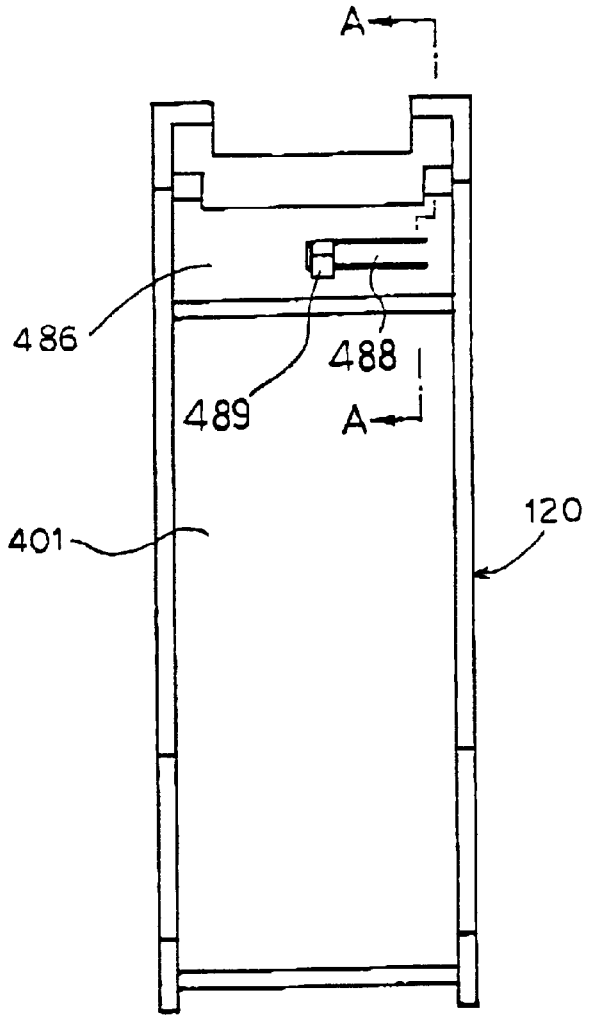
FIG. 27 is a front view showing the interior of the cover body of the cartridge.
Figure 28:
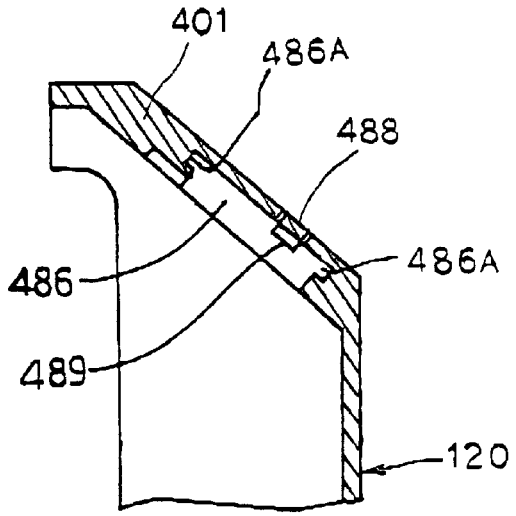
FIG. 28 is a sectional view taken substantially along line A—A in FIG. 27.
Figure 29:
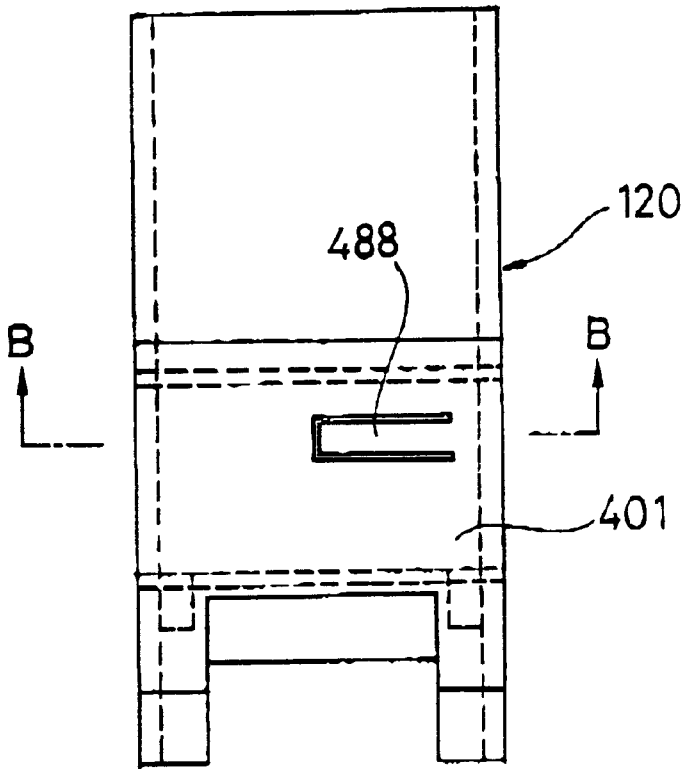
FIG. 29 is a side view showing the free end portion of the lid body.
Figure 30:
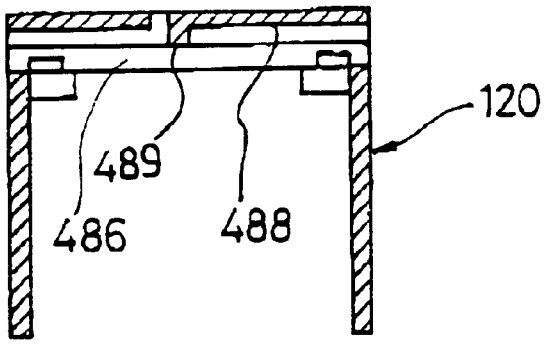
FIG. 30 is a sectional view taken substantially along line B—B in FIG. 29.

Also, the lower surface of the bottom plate 104 is provided with a lock member 115 which is inserted into the unlock hole 18 of the table 13. The lock member 115, as shown in FIG. 26, is constituted by a base 116 fixed to the bottom plate 104 and an elastic lock piece 117 extending from the base 116. The lock piece 117 is movable as shown by a broken line. The lock piece 117 is formed with a recess 117A which is engaged by the stopper piece 170 of the slider 150. If the stopper piece 170 of the slider 150 engages the recess 117A of the lock member 115, the slider 150 will be locked so that it will not move.

If the cartridge 100 is placed on the table 13 of the main body 11, the lock member 115 will be inserted into the unlock hole 18. Then, the lock piece 117 of the lock member 115 is moved to a position indicated by a broken line. The stopper piece 170 of the slider 150 is disengaged from the recess 117A of the lock piece 117, thereby unlocking the slider 150.

The interior surface of a side wall 401 on the free end portion of the lid body 120 is formed with a recess 486, as shown in FIGS. 27 through 30. In both sides of the recess 486, grooves 486A are formed and extend in a vertical direction (direction perpendicular to the paper surface of FIG. 22). A stopper member 487 is inserted into the vertical recess 486 so that it can slide in the vertical direction. Also, the side wall 401 is formed with a tongue piece 488 extending in the vertical direction (lateral direction in FIGS. 27, 29, and 30). The tongue piece 488 has a protrusion 489 on the interior surface thereof.

Figure 31:
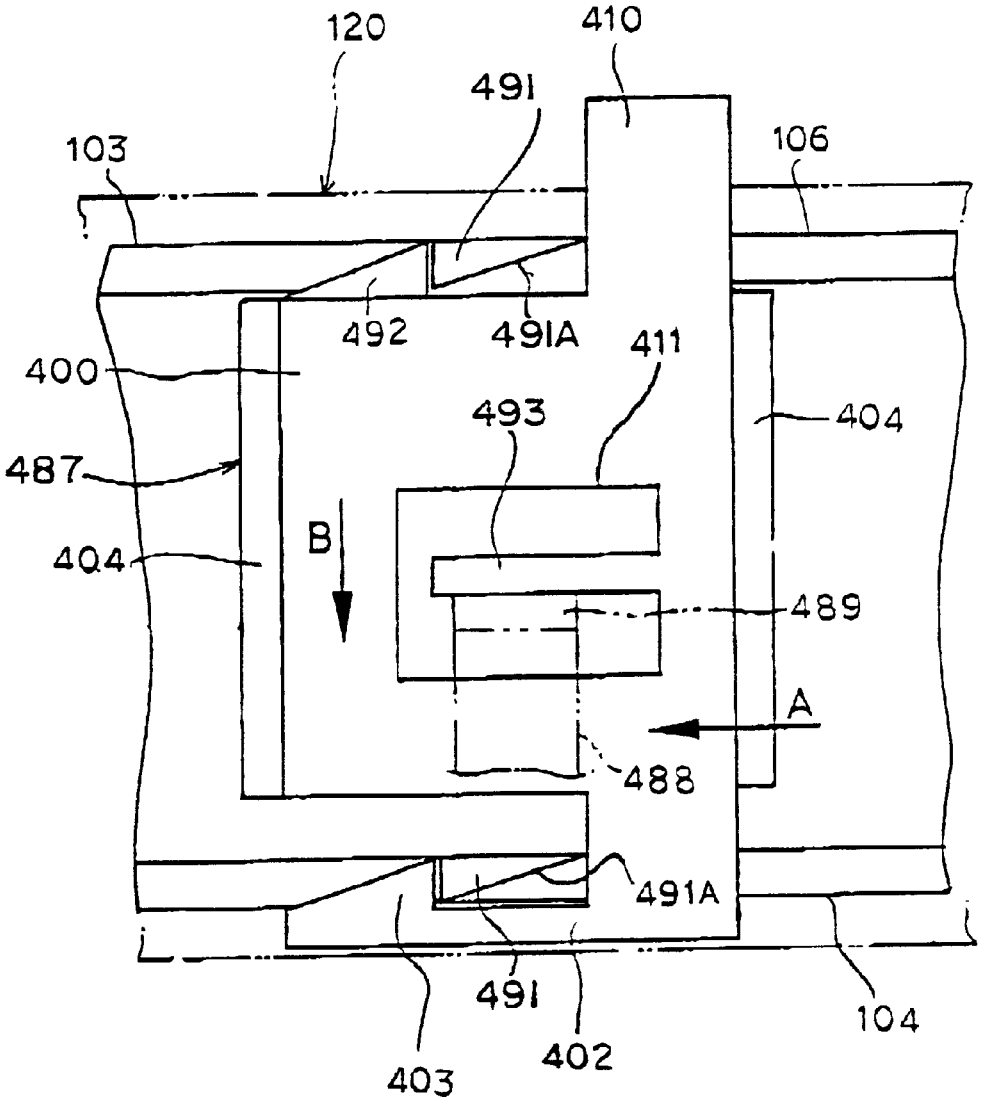
FIG. 31 is a conceptual diagram showing the stopper member of the lid body.

The ceiling plate 106 and bottom plate 104 of the cartridge's main body 103 are provided with triangular engaging protrusions 491 for holding the lid body 120, as shown in FIG. 31.

The stopper member 487 provided in the lid body 120 has a plate-shaped stopper main body 400, which is in turn provided with a protrusion 492 which engages the aforementioned engaging protrusion 491 and a control portion 410 which penetrates the upper plate 120A of the lid body 120 and also extends upward. In the central portion of the stopper body 400 a laterally extending tongue piece 493 is formed by a cutout 411. The protrusion 489 of the tongue piece 488 is inserted into the space between the lower surface 411A of the cutout 411 and the tongue piece 493 and abuts the tongue piece 493 of the stopper member 487, thereby holding the stopper member 487 in the position shown in FIG. 31.

The lower portion of the stopper main body 400 is provided with an arm portion 402 extending in the lateral direction. The point end portion of the arm portion 402 is provided with a protrusion 403 which engages the aforementioned protrusion 491. Between the stopper main body 400 and the protrusion 403 a predetermined gap is formed so that the stopper member 487 can be moved downward.

The main body 400 of the stopper member 487 is provided with flanges 404 on both sides thereof. The flanges 404 engage the vertical grooves 486A of the recess 486, so the stopper member 487 slides vertically along the grooves 486A. If the lid body 120 is closed to the main body 103 of the cartridge 100, the lid body 120 will be moved in a direction of arrow A with respect to the main body 103. Also, the protrusions 493 and 403 of the stopper member 487 of the lid body 120 abut the protrusions 491 of the main body 103 of the cartridge 100 and then slide on the taper surfaces 491A of the protrusions 491. Therefore, the stopper member 487 of the lid body 120 slides downward (i.e., in a direction of arrow B), while bending the tongue piece 493. If the protrusions 493 and 403 of the stopper member 487 of the lid body 120 go over the protrusions 491 of the main body 103 of the cartridge 100, the stopper member 487 will be moved upward by the elastic force of the tongue piece 493. As a result, the protrusions 493 and 403 of the stopper member 487 of the lid body 120 engage the protrusions 491 of the main body 103 of the cartridge 100. In this way, the cover body 120 is locked to the main body 103 of the cartridge 100.

In order to open the lid body 120, the control portion 410 is depressed. If the control portion 410 is depressed, the stopper member 487 of the lid body 120 will slide downward while bending the tongue piece 493. Therefore, the protrusions 493 and 403 of the stopper member 487 of the lid body 120 are disengaged from the protrusions 491 of the main body 103 of the cartridge 100. In this way, the lid body 120 can be opened from the main body 103 of the cartridge 100.

A flat guide wall portion 130 is continuously formed on the front side of the main body 103 of the cartridge 100 and forms the conveyer path 113 of the clip plate 101. The slider 150 is attached to the guide wall portion 130 so that it can move right and left (i.e., in a lateral direction in which the clip plate 101 is guided).

Figure 32:
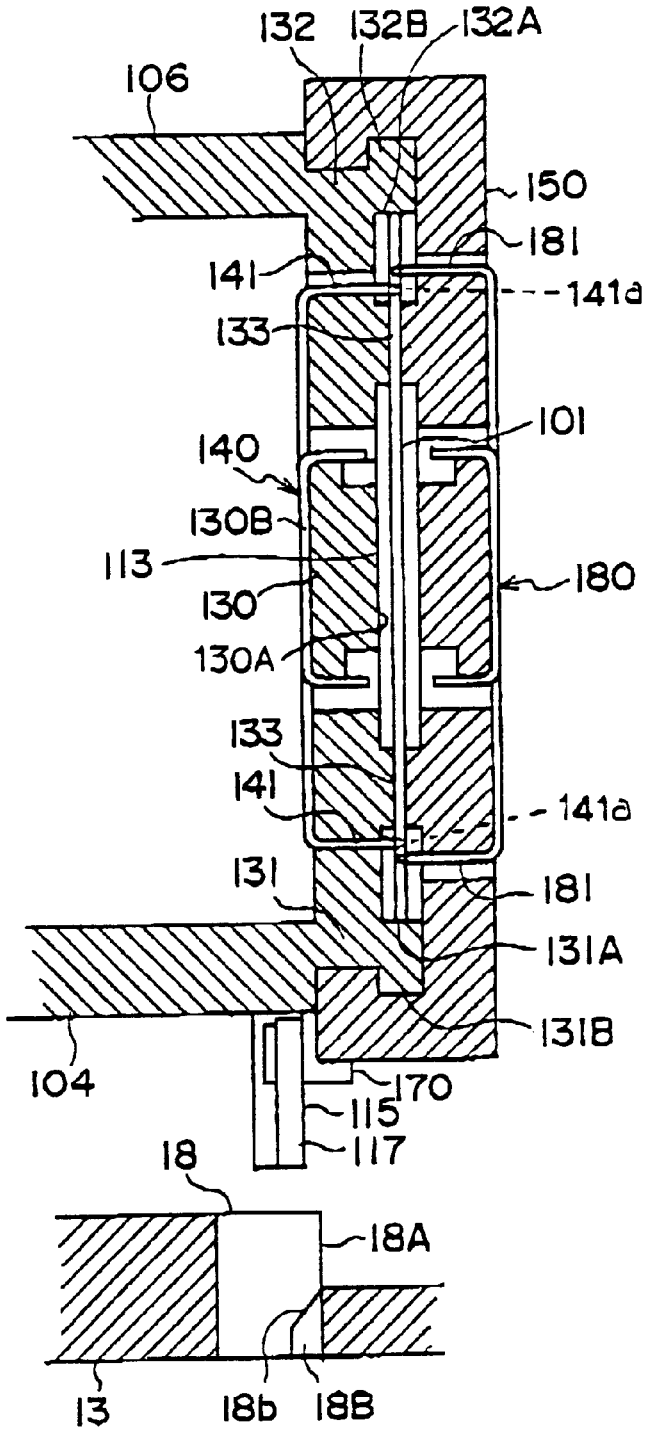
FIG. 32 is a sectional view showing the guide wall portion of the cartridge and the slider.
Figure 33:
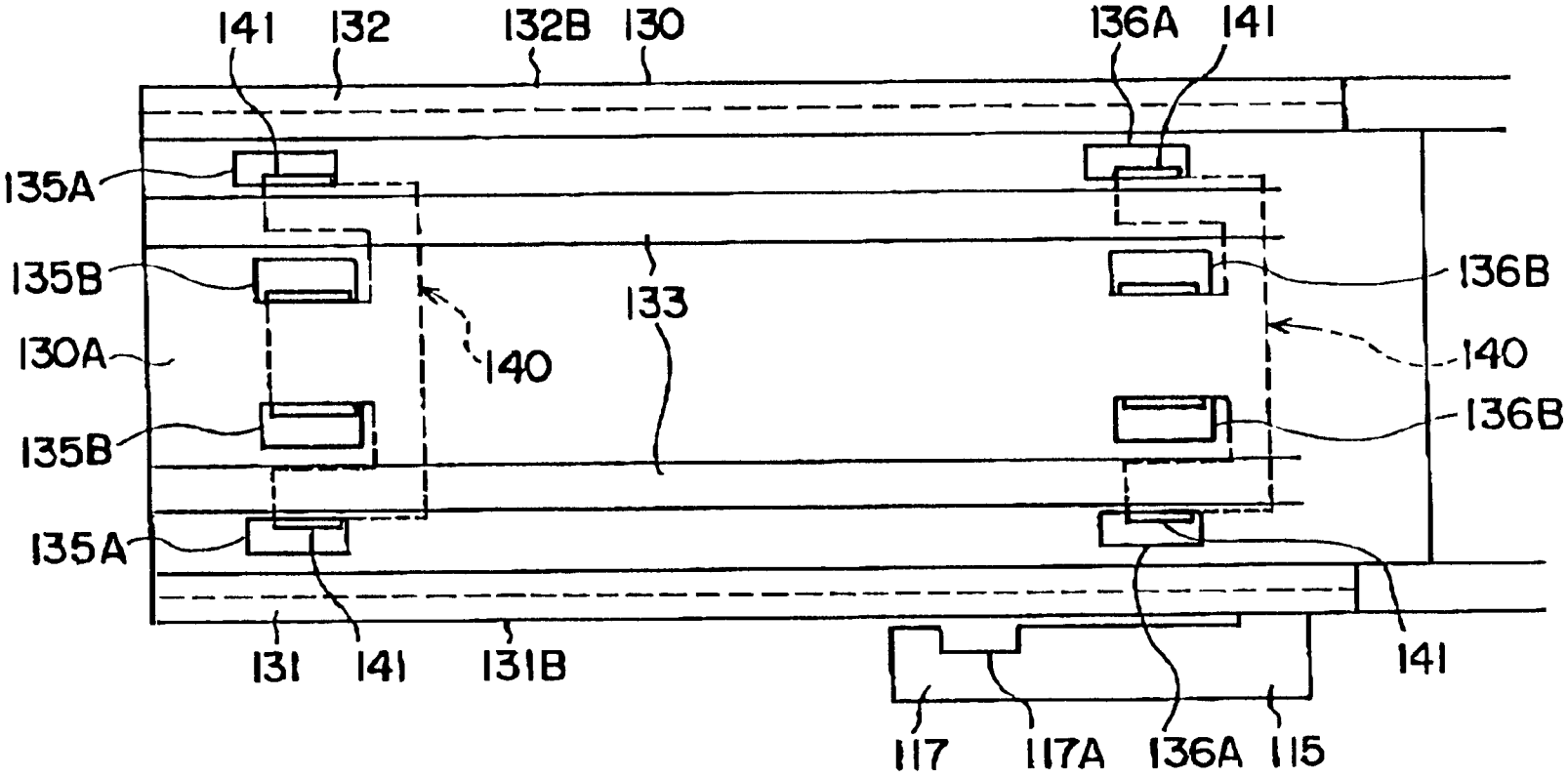
FIG. 33 is a side view showing the front surface of the guide wall portion.

The guide wall portion 130 is formed with lower and upper guide portions 131 and 132 which form guide surfaces 131A and 132A for guiding the upper and lower ends of the clip plate 101, as shown in FIGS. 32 and 33. The lower portion of the lower guide portion 131 and the upper portion of the upper guide portion 132 have guide rails 131B and 132B which extend in the lateral direction for guiding the slider 150 in the lateral direction. The intermediate portion of the front surface 130A of the guide wall portion 130 are formed with a pair of upper and lower protrusions 133, and the upper and lower land portions 133 extend in the lateral direction for guiding the clip plate 101. The front surface 130A of the guide wall portion 130 and the guide rails 131B and 132B form the conveyer path 113.

Also, the guide wall portion 130 is formed with four rectangular holes 135A and 135B at the front end side (left side in FIG. 33) and four rectangular holes 136A and 136B at the rear end side. The nonreturn pawls 141 of front and rear nonreturn pawl plates 140 are attached to the back surface 130B of the guide wall portion 130 and extend into the front and rear rectangular holes 35A and 136A. The point end portions 141*a* of the nonreturn pawl 141 protrude from the front surface 130A of the guide wall portion 130, as shown in FIG. 32, and catch the clip plate 101. This catching prevents the clip plate 101 from going backward.

Figure 34:
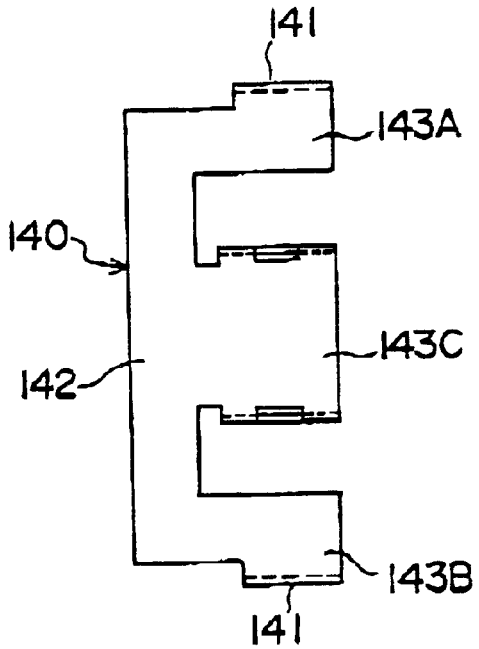
FIG. 34(A) is a front view showing the nonreturn pawl plate of FIG. 32.
FIG. 34(B) is a side view showing the nonreturn pawl plate.
FIG. 34(C) is a bottom view showing the nonreturn pawl plate.
Figure 34:
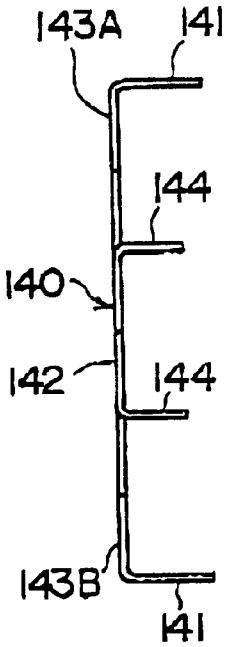
Figure 34:
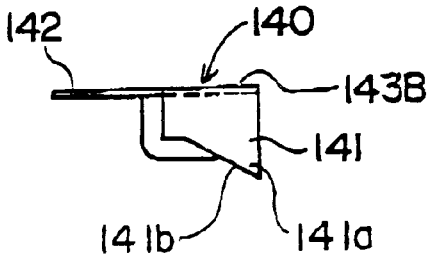
Figure 35:
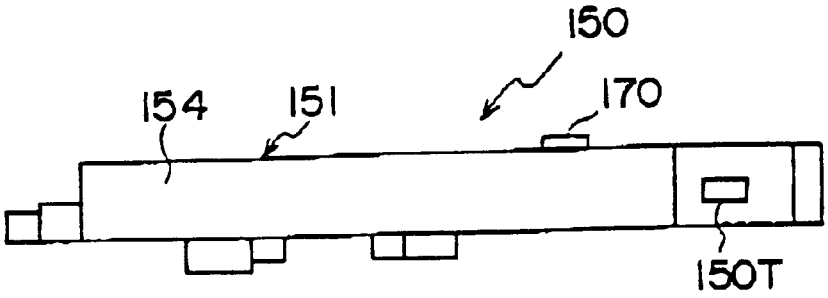
FIG. 35 is a top view showing the slider, pawl plates being removed.
Figure 36:
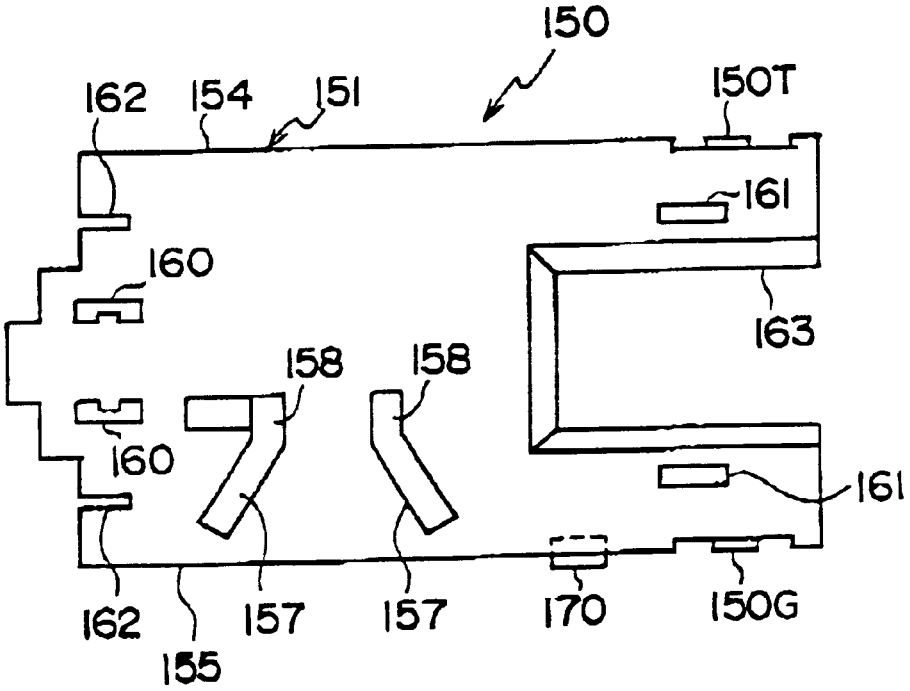
FIG. 36 is a front view showing the slider, the pawl plates being removed.
Figure 37:
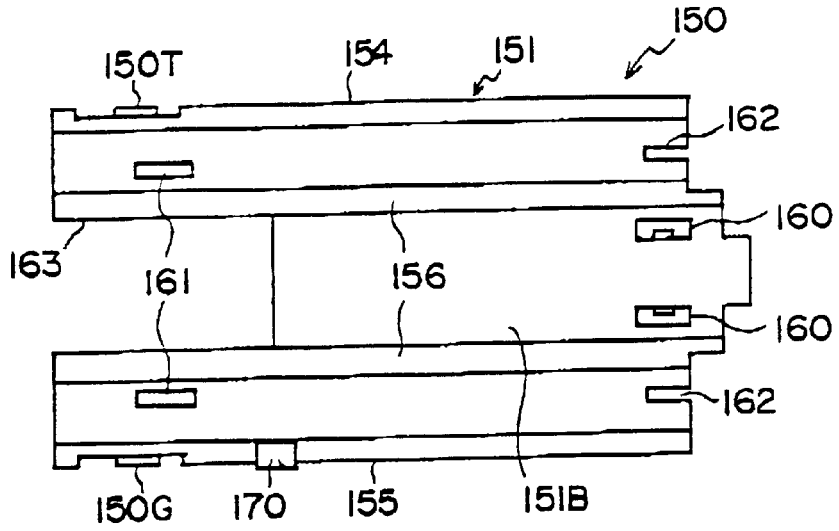
FIG. 37 is a back view showing the slider, the pawl plates being removed.
Figure 38:
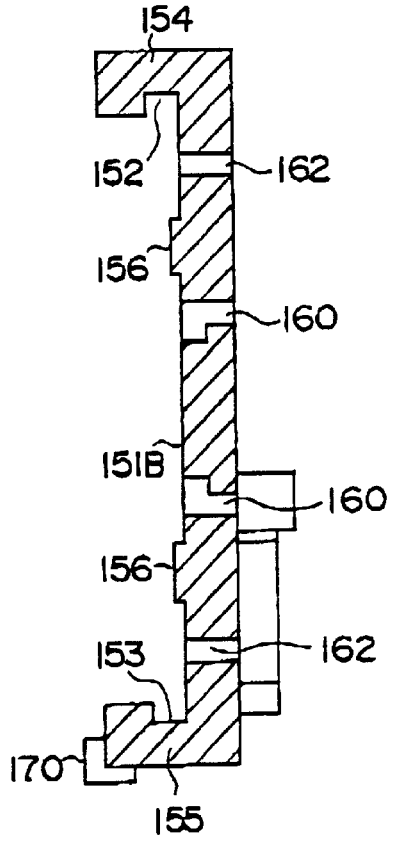
FIG. 38 is a vertical sectional view showing the slider, the pawl plates being removed.

The nonreturn pawl plate 140 is formed from a generally E-shaped flat plate 142, as shown in FIGS. 34(A) through 34(C). The nonreturn pawls 141 are bent and formed on the upper and lower plate portions 143A and 143B of the flat plate 142, and holding pawls 144 are bent and formed on the intermediate portion 143C. The holding pawls 141 of the front nonreturn pawl plate 140 are inserted into the rectangular holes 135B of the guide member 130 and are caulked, thereby attaching the front nonreturn pawl plate 140 to the guide wall portion 130. Likewise, The holding pawls 141 of the rear nonreturn pawl plate 140 are inserted into the rectangular holes 136B of the guide member 130 and are attached to the guide wall portion 130.

The nonreturn pawl 141 has an inclined portion 141*b* which is reduced rearward from the point end portion 141*a*, as shown in FIG. 34(C). Therefore, the point end portion 141*a* can be retracted left from the position shown in FIG. 32 by the elastic force of the flat plate 142 so that the point end portion 141*a* does not interfere with the feeding of the clip plate 101.

(Slider)

The slider 150 is formed from a rectangular plate member 151, as shown in FIGS. 35 through 38. The plate member 151 is provided with upper and lower holding portions 154 and 155, which are in turn formed with upper and lower grooves 152 and 153. The upper and lower grooves 152 and 153 engage the upper and lower guide rails 132B and 131B of the guide wall portion 130. The lower portion of the lower holding portion 155 is provided with a stopper piece 170. The interior side of the plate member 151 is provided with a pair of land portions 156 extending in the lateral direction. The exterior side of the plate member 151 is provided with guide portions 157 and stopper portions 158 for guiding the stopper protrusion 36A (FIG. 12) of the arm portion 36 of the second link member 32.

Between the stopper portions 158 the stopper protrusion 36A of the second link member 32 is inserted, and if the arm portion 36 of the second link member 32 is rotated on the shaft J, the slider 150 will be reciprocated in the lateral direction.

The plate member 151 is formed with upper and lower rectangular holes 160 and 161 at the front and rear sides, respectively. The front end of the plate member 151 is formed with upper and lower slit-shaped cutouts 162, and the rear end portion is formed with a rectangular cutout 163 so that the tape 201 of the connected clip body 200 can be detected by the sensor 26 (FIG. 2).

Figure 39:
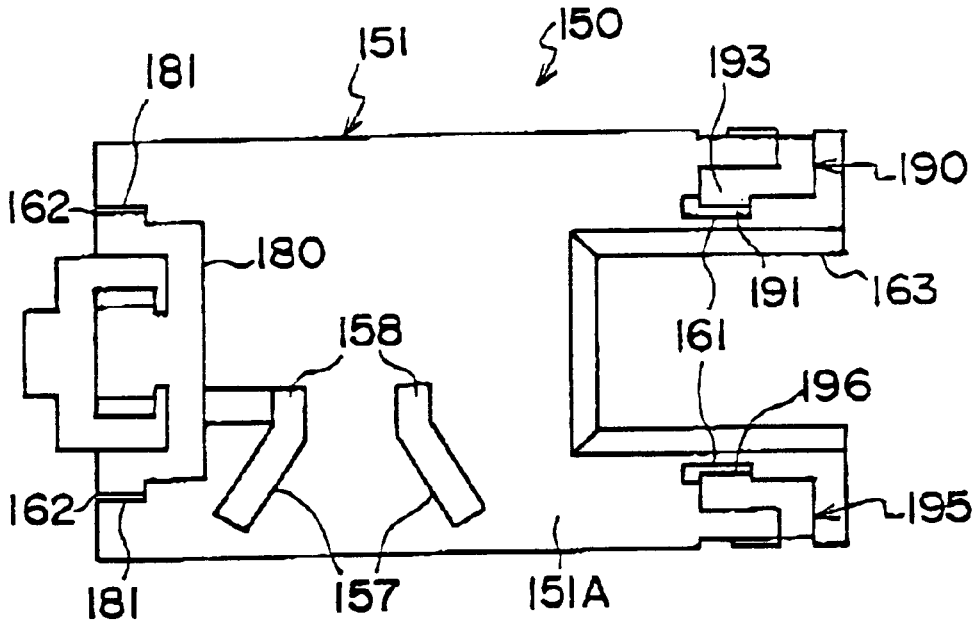
FIG. 39 is a front view showing the slider, the pawl plates being fitted into holes.
Figure 40:
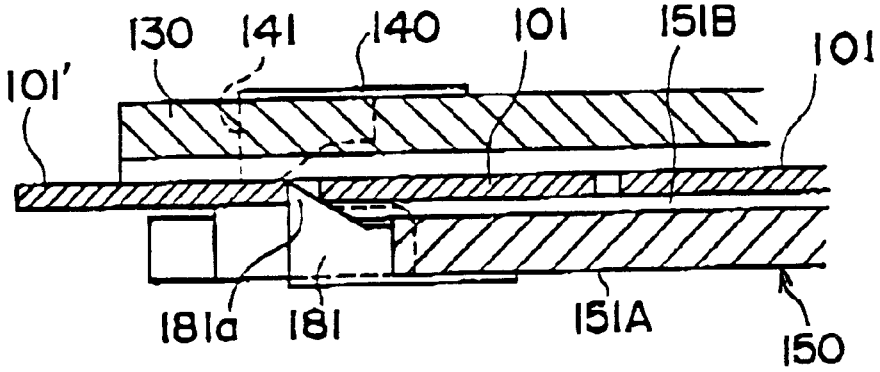
FIG. 40 is a horizontal sectional view showing the slider, the pawl plates being fitted into holes.

As shown in FIG. 39, a forward-feed pawl plate 180 is attached to the exterior surface 151A of the plate member 151. The forward-feed pawls 181 of the forward-feed pawl plate 180 are fitted into the cutouts 162. As shown in FIGS. 32 and 40, the point end portion 181*a* of the forward-feed pawl 181 protrudes from the interior surface 151B of the plate member 151 and catches the clip plate 101. This catching feeds the clip plate 101 forward.

Similarly, backward-feed pawl plates 190 and 196 are attached to the exterior surface 151A of the plate member 151. The backward-feed pawls 191 and 196 of the backward-feed pawl plates 190 and 196 are inserted into the upper and lower rectangular holes 161. The point end portions 191*a* and 195*a* of the backward-feed pawls 191 and 196 catch the clip plate 101 in the same way as the aforementioned. The feed pawls 181, 191, and 196, as shown in FIGS. 32 and 40, are shifted from each other in lateral and vertical directions so that they do not interfere with the front and rear nonreturn pawls 141 attached to the guide wall portion 130.

The forward-feed pawl plate 180 is formed from a generally E-shaped flat plate 182, as shown in FIG. 41(A). The forward-feed pawls 181 are bent and formed on the upper and lower plate portions 183A and 183B of the flat plate 182; and holding pawls 184 are bent and formed on the intermediate portion 183C. The holding pawls 184 are inserted into the rectangular holes 160 of the plate member 151 and are caulked, thereby attaching the forward-feed pawl plate 180 to the slider 150.

The forward-feed pawl 181 has an inclined portion 181*b* which is reduced rearward from the point end portion 181*a*, as shown in FIG. 41(B). Therefore, the point end portion 181*a* can be retracted right from the position shown in FIG. 32 (downward direction in FIG. 40) by the elastic force of the flat plate 182 so that the point end portion 181*a* does not interfere with the backward (right) movement of the slider 150.

The upper backward-feed pawl plate 190, as shown in FIG. 42, is constituted by a horizontal attaching piece 192 with a rectangular hole 192*a*, a vertical elastic plate portion 193 extending from the attaching piece 192, and a backward-feed pawl 191 extending from the vertical portion 193 in opposition to the attaching piece 192. The upper backward-feed pawl plate 190 is attached to the slider 150, by fitting the protrusion 150T of the holding portion 154 of the slider 150 into the rectangular hole 192*a* of the attaching piece 190 and inserting the backward-feed pawl 191 into the upper rectangular hole 161 of the slider 150.

The lower backward-feed pawl plate 196, as shown in FIG. 43, is constituted by a horizontal attaching piece 197 with a rectangular hole 197*a*, a vertical elastic plate portion 198 extending from the attaching piece 197) and a backward-feed pawl 196 extending from the vertical portion 198 in opposition to the attaching piece 197. The lower backward-feed pawl plate 195 is attached to the slider 150, by fitting the protrusion 150G of the holding portion 155 of the slider 150 into the rectangular hole 197*a* of the attaching piece 197 and inserting the backward-feed pawl 196 into the lower rectangular hole 161 of the slider 150.

Even in the backward-feed pawl plates 190 and 196, as with the forward-feed pawl plate 180, the point end portions 191*a* and 196*a* of the backward-feed pawls 191 and 196 are retracted by the elasticity of the elastic plate portions 193 and 198 so that the point end portions do not interfere with the backward movement of the slider 150.

(Connected Clip Body)

Figure 44:
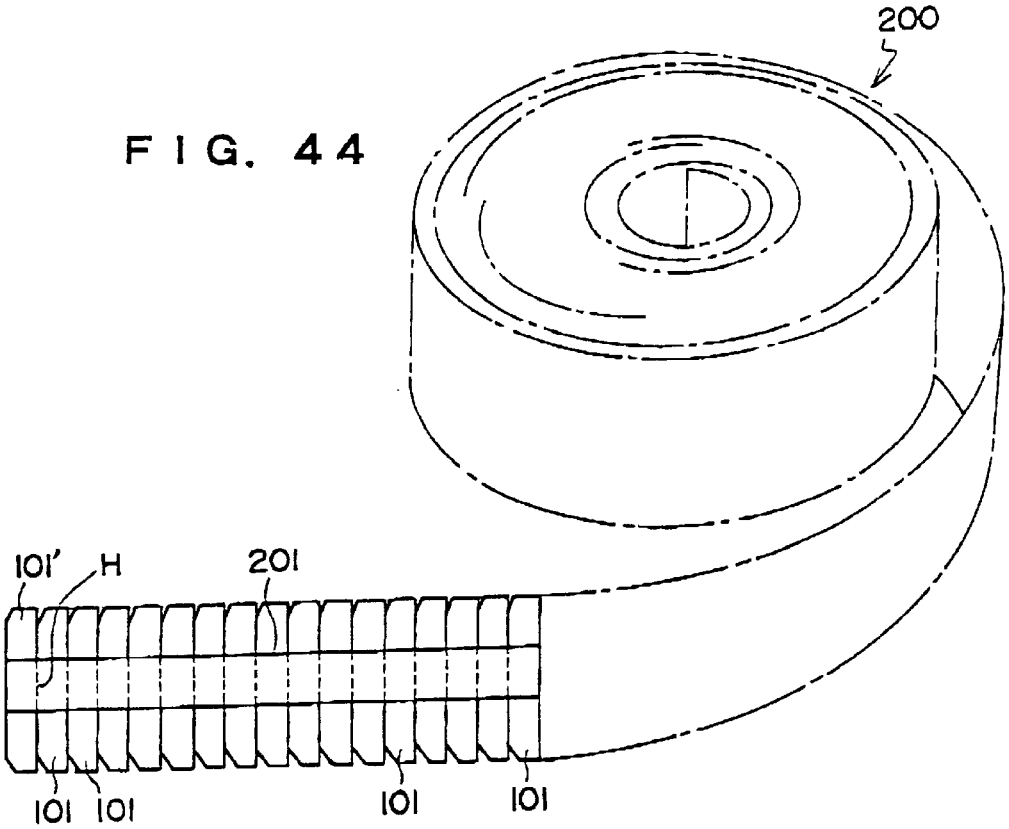
FIG. 44 is a perspective view showing a connected clip body used in the cartridge of the present invention.

In the connected clip body 200, as shown in FIG. 44, a plurality of clip plates 101 are bonded to a ribbon tape 201 and connected. The clip plates 101 bonded to the tape 201 are wound in roll form. The clip plate 101 is formed from metal, and in FIG. 44, the clip plates 101 are disposed with the longitudinal portions adjacent to each other. Therefore, if the clip plate 101 is bent, it will be separated from the tape 201 at a vertical broken line H.

(Operation)

A description will hereinafter be made the operation of the clipping unit constructed as described above.

Figure 23:
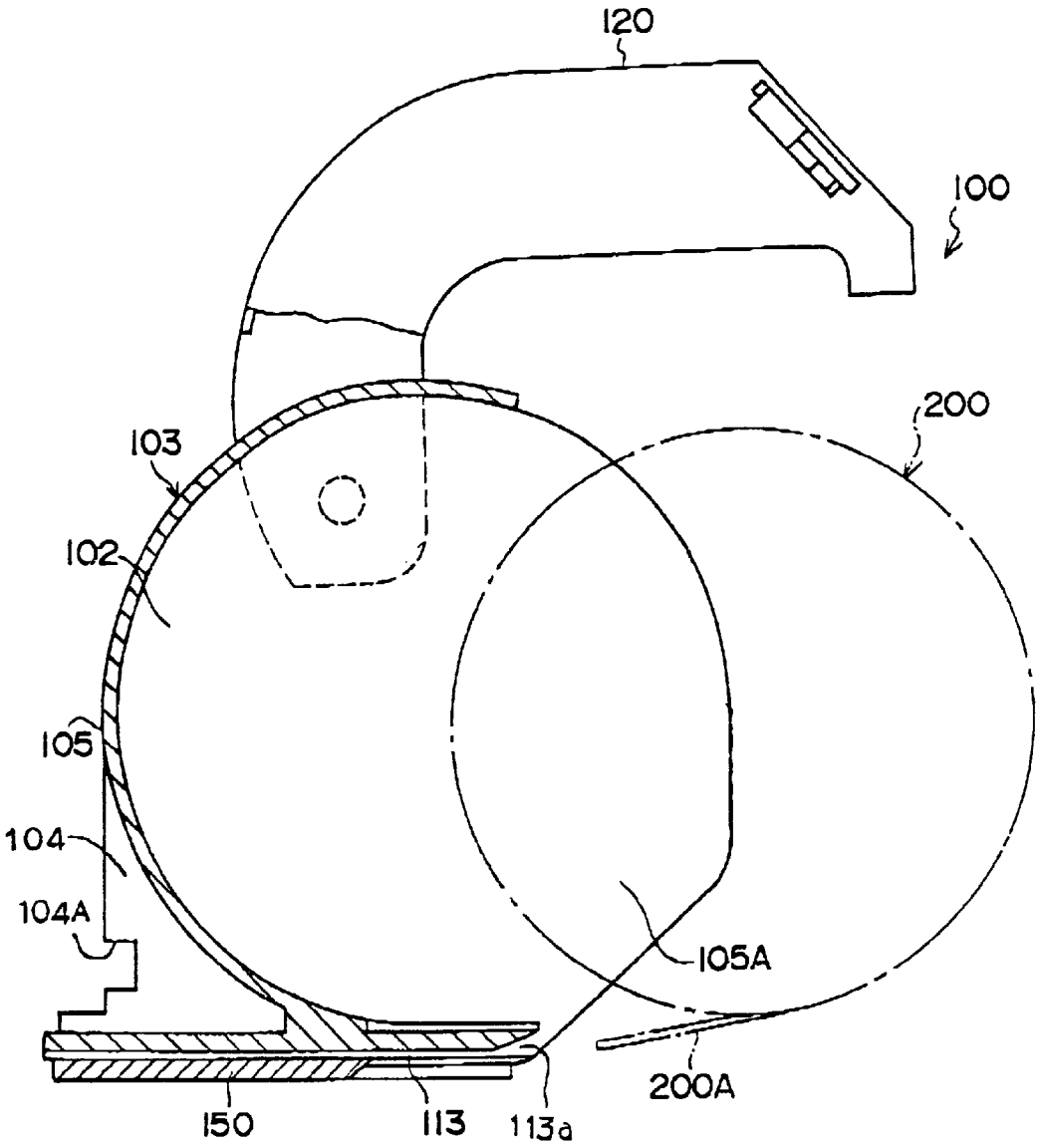
FIG. 23 is a horizontal sectional view showing the cartridge, the cover being opened.
Figure 24:
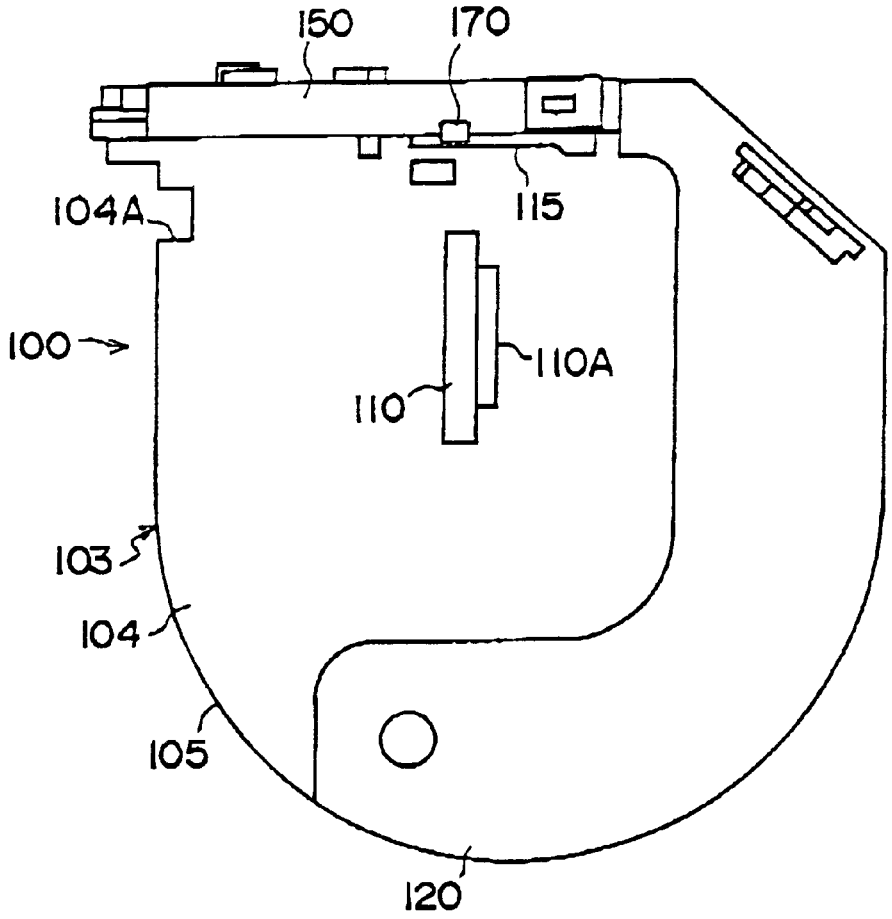
FIG. 24 is a bottom view showing the cartridge.
Figure 25:
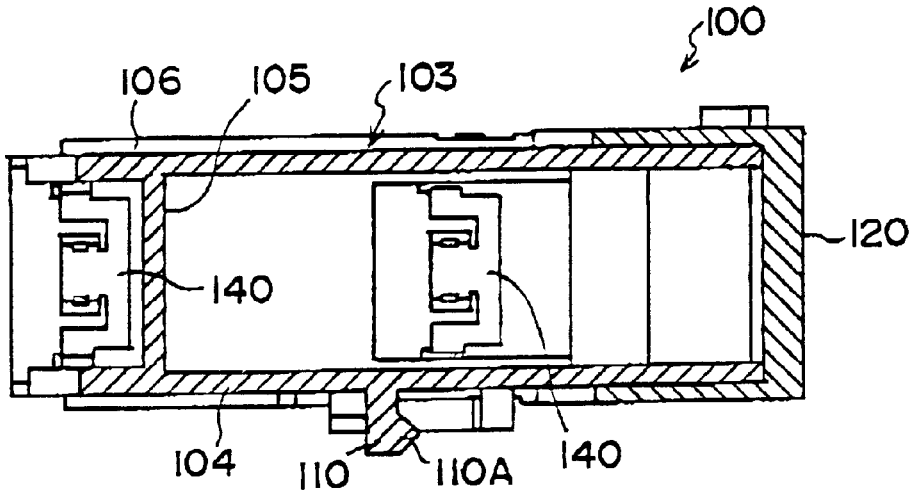
FIG. 25 is a cross sectional view showing the cartridge.

As shown in FIG. 23, the lid body 120 of the cartridge 120 is first opened, and the connected clip body 200 is put into the housing chamber 102. Then, the leading end portion 200A of the connected clip body 200 is inserted into the conveyer path 113 and the lid body 120 is closed. Since the inlet 113*a* of the conveyer path 113 faces the opening 105A, the leading end portion 200A (FIG. 23) of the connected clip body 200 can easily be inserted into the conveyer path 113.

Then, the recesses 106A and 104A of the ceiling plate 106 and bottom plate 104 of the cartridge 100 are fitted onto the guide rail 24 of the main body 11, and the cartridge 100 is placed on the table 13 of the main body 11. If the cartridge 100 is placed on the table 13, the stopper piece 110 of the cartridge 100 is inserted into the stopper hole 19 of the table 13, and the protrusion 110A of the stopper piece 110 engages the stopper portion 22A of the stopper piece 22 of the main body 11. In this way, the cartridge 100 is locked to the main body 11.

Also, the lock member 115 of the cartridge 100 is inserted into the unlock hole 18 of the table 13. The lock member 115 is moved to the broken line position shown in FIG. 26 by the protrusion 18B of the unlock hole 18, and the slider 150 is unlocked. The stopper protrusion 36A of the arm portion 36 of the slider reciprocating mechanism 30 is guided by the guide portions 157 of the slider 150 and is inserted between the stopper portions 158.

Before the drive motor 81 is driven, the link-member drive cam 85 and the clamp-member drive cam 90 are in the initial position shown in FIGS. 9 through 11 and FIG. 14, and the slider 150 is in the home position shown in FIGS. 1 and 2. The sensor 26 has detected the tape 201 of the connected clip body 200 present in the conveyer path 113 of the cartridge 100 and has detected the clip plates 101. Also, the microswitch M2 has detected the recess 90A of the clamp-member drive cam 90. The clamp members 51 and 52 are in the home position shown in FIGS. 10 and 14.

Then, a bundle of sheets S are placed on the stepped portion 28A of the exterior wall 28 of the housing 12 and the upper surface Va of the front wall portion V.

In this condition, if a clip signal is output from the main body of a copying machine (not shown), the control circuit (not shown) will drive the drive motor 81, based on the clip signal, because the sensor 26 has detected the clip plates 101. If the drive motor 81 is driven, the link-member drive cam 85 will be rotated in the clockwise direction (in FIGS. 9 and 11, or in the counterclockwise direction in FIG. 10) through the gear 83 and the speed reduction gear train 84.

If the link-member drive cam 85 is rotated and therefore the point end portion 31*b* of the arm portion 31A of the first link member 31 goes into the small diameter portion 36A of the cam groove 86 of the link-member drive cam 85, the arm portion 31A of the first link member 31 is rotated in the clockwise direction of FIG. 12 (counterclockwise direction in FIG. 2). The second link member 32 is rotated with the first link member 31, and the arm portion 36 of the second link member 32 is rotated in the direction of arrow of FIG. 2 (counterclockwise direction). The rotation of the arm portion 36 causes the slider 150 to move in the left direction of FIGS. 1 and 2.

With the movement of the slider 150, the point end portion 181*a* of the forward-feed pawl 181 catches the leading clip plate 101', as shown in FIG. 40, and the clip plate 101' is fed forward along with the movement of the slider 150. At this time, if the backward-feed pawls 191 and 196 of the slider 150 catch another clip plate 101, the clip plates 101' and 101 will be fed by the forward-feed pawl 181 and the backward-feed pawls 191 and 196.

Since the clip plates 101 are interconnected by the tape 201, the clip plates 101 in the conveyer path 113 are fed forward (to the left side in FIGS. 1 and 2) and the clip plates 101 in the housing chamber 102 are fed to the conveyer path 113.

Also, the upper and lower land portions 133 are formed on the exterior side of the guide wall portion 130 and likewise the upper and lower land portions 156 are formed on the interior of the slider 150. Therefore, even if the clip plates 101' and 101 had been slightly deformed, there would be no obstacle to the feeding of the plates, and they could be smoothly fed.

Because the forward-feed pawls 181 are provided on the upper and lower portions of the slider 150, the clip plate 101' is fed in a stable state without inclining.

If the link member drive cam 85 is further rotated and the point end portion 31*b* of the arm portion 31A of the first link member 31 arrives near the smallest-diameter portion 86*d* (FIG. 11) of the cam groove 86, then the slider 150 will be moved further in the left direction and the clip plate 101' will be fed to a position which abuts the stopper 29. If the clip plate 101' abuts the stopper 29, the movement of the slider 150 will be stopped and the clip plate 101' will be held by the protrusions 73B and 77B of the clamp members 51 and 52. Then, the microswitch M1 detects the clip plate 101' held by the clamp members 51 and 52.

If the point end portion 31*b* of the arm portion 31A of the first link member 31 reaches the smallest-diameter portion 86*d* of the cam groove 86, the first link member 31 will be moved further in the clockwise direction of FIG. 12 (counterclockwise direction in FIG. 2), but since the slider 150 has been stopped by the stopper 29, only the first link member 31 will be rotated against the urging force of the spring 37 with respect to the second link member 32.

The rotational quantity of the first link member 31 is set so that the slider 150 moves a distance greater than the width of the clip plate 101. Therefore, even if there were fluctuation in the gap between the clip plates 101, the clip plate 101 could be reliably fed to a predetermined position, because the first link member 31 rotates with respect to the second link member 32 and absorbs that fluctuation.

If the link-member drive cam 85 is further rotated and the point end portion 31*b* of the arm portion 31A of the first link member 31 arrives from the smallest-diameter portion 86*d* at the large-diameter portion 86B, the first link member 31 will be rotated in the counterclockwise direction of FIG. 12 (clockwise direction in FIG. 12). The second link member 32 rotates in the same direction with the first link member 31, so the slider 150 returns to the home position.

When the slider 150 returns to the home position, the clip plate 101 is prevented from going backward along with the slider 150, by the nonreturn pawls 141 of the nonreturn pawl plates 140 attached to the guide wall portion 130 of the main body 11. The nonreturn pawls 141 are provided on the upper and lower portions of the guide wall portion 130, so there is no possibility that the clip plate 101 will incline when the slider 150 returns.

Figure 45:
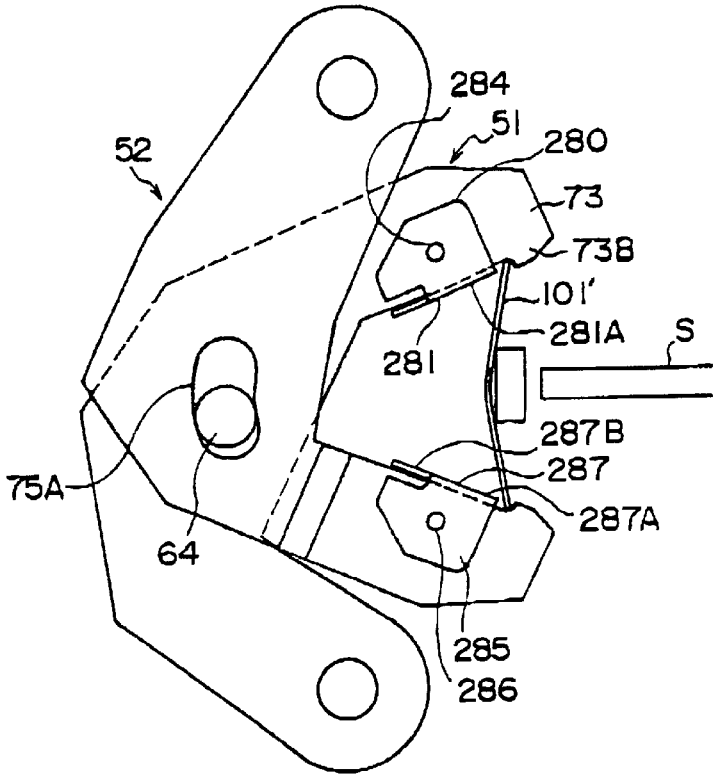
FIG. 45 is a side view showing how a clip plate is bent by the clamp members.

If the link-member drive cam 85 is further rotated and the point end portion 31*b* of the arm portion 31A moves on the large-diameter portion 86B of the cam groove 86 and if the actuator shaft 62 fitted in the first clamp rotating member 53 abuts the circumferential surface of the increasing portion R2 of the clamp-member drive cam 90, then the clamp rotating members 53 and 54 will be rotated on the shaft 63 in the counterclockwise direction in FIG. 14. This rotation causes the upper and lower clamp members 51 and 52 to rotate in a closing direction. If the clamp members 51 and 52 are rotated in the closing direction, the clip member 101 will be pushed forward and bent at the central portion, as shown in FIG. 45. At this time, since the front end of the slider 150 is between the clamp portions 73 and 74 of the clamp members 51 and 52 and supports the back surface of the clip plate 101', the clip plate 101' is bent in the direction of the sheet bundle S and the bending of the clip plate 101' in the opposite direction is prevented.

Figure 46:
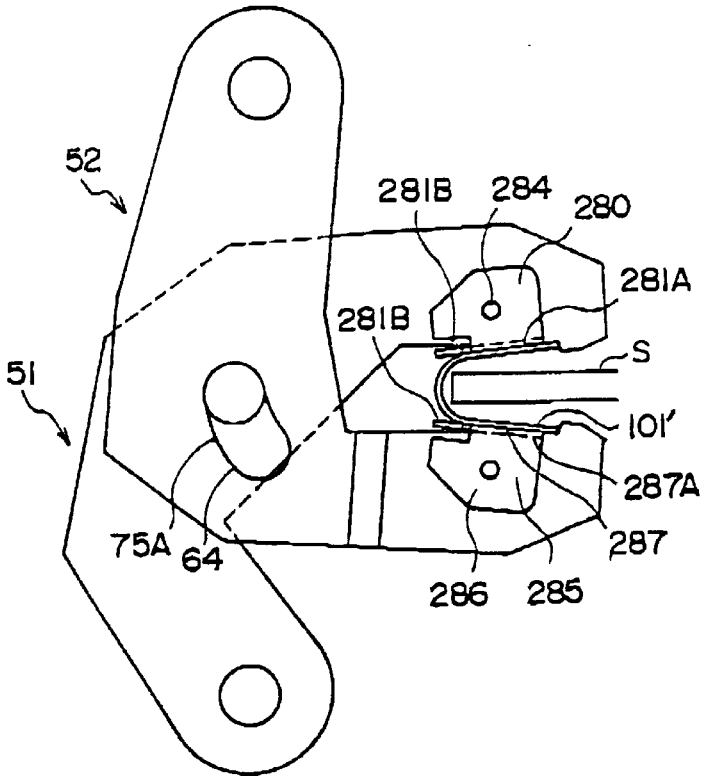
FIG. 46 is a side view showing how the clip plate is folded in two by the clamp members.

Furthermore, if the link-member drive cam 85 rotates and the actuator shaft 62 of the clamp rotating member 53 moves on the circumference of the increasing portion R2 of the clamp-member drive cam 90 toward the large-diameter portion R3, then the clamp members 51 and 52 will be rotated further in the closing direction. As a consequence, the clip plate 101' is folded in two by the clamp portions 73 and 77 of the clamp members 51 and 52, as shown in FIG. 46. Since this condition does not need to be held long, the large-diameter portion R3 of the cam 90 may be narrowed and the increasing portion R2 widened.

In the position shown in FIG. 46, the front portion 281A of the press portion 281 of the upper press member 280 is in contact with the inclined surface 73*b* of the clamp portion 73. The lower press member 285 is also in the same state.

Figure 47:
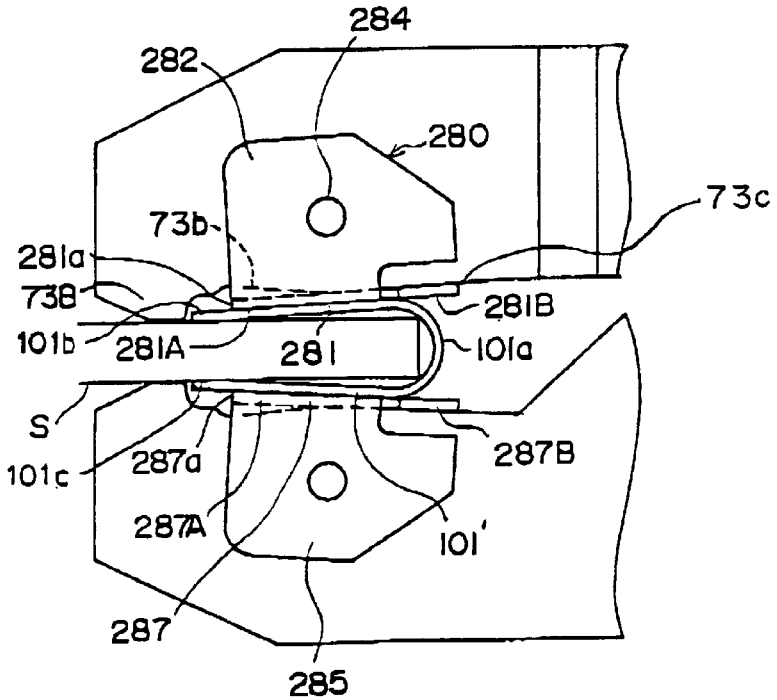
FIG. 47 is a side view showing the relation between the folded clip plate and the press members.

If the actuator shaft 62 of the clamp rotating member 53 reaches the circumferential surface near the boundary between the increasing portion R2 and the large-diameter portion R3 of the clamp-member drive cam 90, the clamp portions 73 and 77 will be further closed. As a result, as shown in FIG. 47, the bent portion 101*a* of the clip plate 101' causes the rear portion 281B of the press portion 281 of the upper press member 280 to abut the inclined surface 73*c* of the clamp portion 73. For this reason, the front end portion 281*a* of the upper press member 281 protrudes downward. In the same way, the front end portion 287*a* of the press portion 287 of the lower press member 285 protrudes upward.

Therefore, in the state where the opposite ends 101*b* and 101*c* of the clip plate 101' are pressed from above and below by the front end portions 281*a* and 287*a* of the upper and lower press members 280 and 285, the upper and lower clamp members 51 and 52 caulks the bent portion 101*a* of the clip plate 101' through the upper and lower press portions 281 and 287, and consequently, the clip plate 101 is closely attached to the sheet bundle S and folded, thereby clipping the sheet bundle S. More specifically, the opposite ends 101*b* and 101*c* of the clip plate 101' are prevented from floating off the sheet bundle S and can reliably clip the end portion of the sheet bundle S.

If the link-member drive cam 85 rotates and the actuator shaft 62 of the clamp rotating member 53 moves on the circumferential surface of the reducing portion R4 of the clamp-member drive cam 95, the clamp rotating members 53 and 54 will be rotated on the shaft 63 in the clockwise direction and the clamp members 51 and 52 will be rotated in an opening direction opposite to the aforementioned. If the actuator shaft 62 of the clamp rotating member 53 reaches the circumferential surface of the small-diameter portion R1 of the clamp-member drive cam 90, that is, if the link-member drive cam 85 and the clamp-member drive cam 90 make one revolution, the clamp members 51 and 52 will return to the home position shown in FIG. 14. The microswitch M2 detects the recess 90A of the clamp-member drive cam 90, and the operation of the drive motor 81 is stopped.

As previously described, the slider 150 is attached to the cartridge 100. Therefore, when the cartridge 100 is removed from the table 13 of the main body 11, there is no possibility that the clip plates 101 will be drawn out by the slider 150. For this reason, when the cartridge 100 is again attached to the table 13, there is no disadvantage that the clip plates 101 drawn out will interfere with the attachment of the cartridge 100 to the table 13. In addition, since there is no possibility that the clip plates 101 drawn out will have to be separated to attach the cartridge 100 to the table 13, clip plates 101 can be saved.

If the cartridge 100 is removed from the table 13, the slider 10 will be locked by the lock piece 117 and the stopper piece 170. Therefore, clip plates 101 are prevented from being drawn out from the cartridge 100 by movement of the slider 150.

When the cartridge 100 is loaded with a new connected clip body 200, if the leading end of the new connected clip body 200 is set so as to be located behind the trailing end of the remaining connected clip body in the conveyer path 13, then the clip plates 101 of the new connected clip body 200 will be fed forward by the backward-feed pawls 191 and 196 of the slider 150 and the clip plates 101 of the remaining connected clip body will be fed forward by the forward-feed pawls 181, and consequently, there is no need to discard the remaining connected clip body 200.

Figure 48:
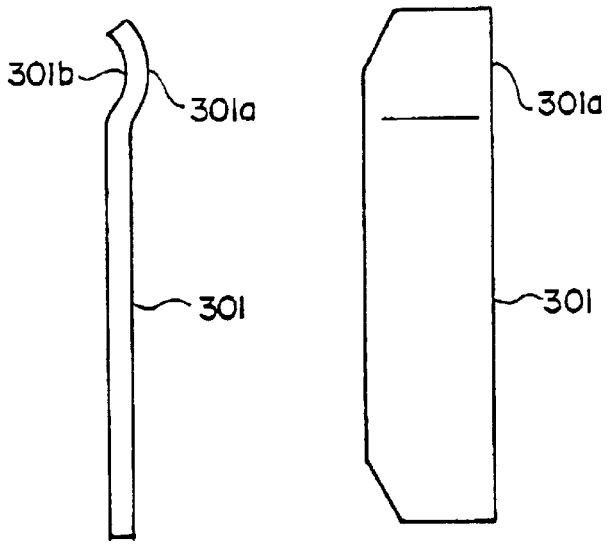
FIG. 48 is a schematic view showing a modification of the clip plate.
Figure 49:
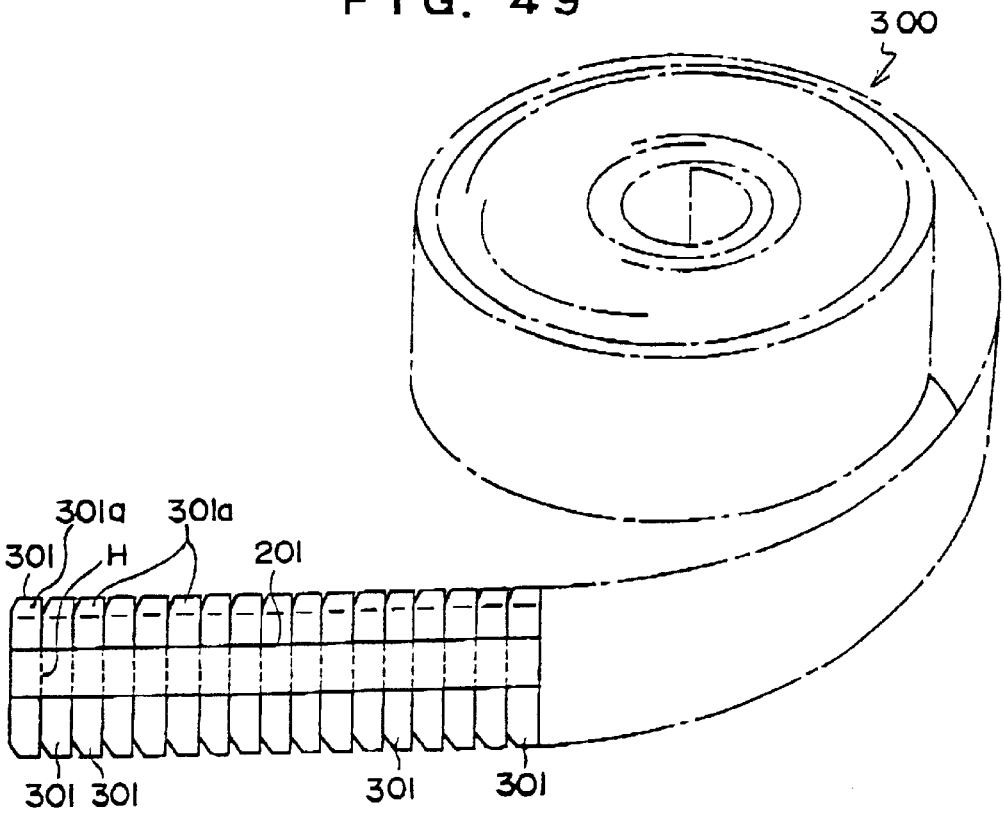
FIG. 49 is a perspective view showing a connected clip body consisting of clip plates each formed with a depressed portion.

In the aforementioned embodiment, while the clip plate 101 is flat in shape, it may be a clip plate 301 formed with a protrusion 301*a* which is curved at the upper end (one end) and which protrudes in a right direction, as shown in FIG. 48. A plurality of clip plates 301, as shown in FIG. 49, are bonded to a ribbon tape 201, and with the depressed portion 301*b* of the protrusion 301*a* disposed inside, the clip plates 301 are formed into a connected clip body 300 wound in roll form. The connected clip body 300 is housed in the cartridge 100.

Figure 50:
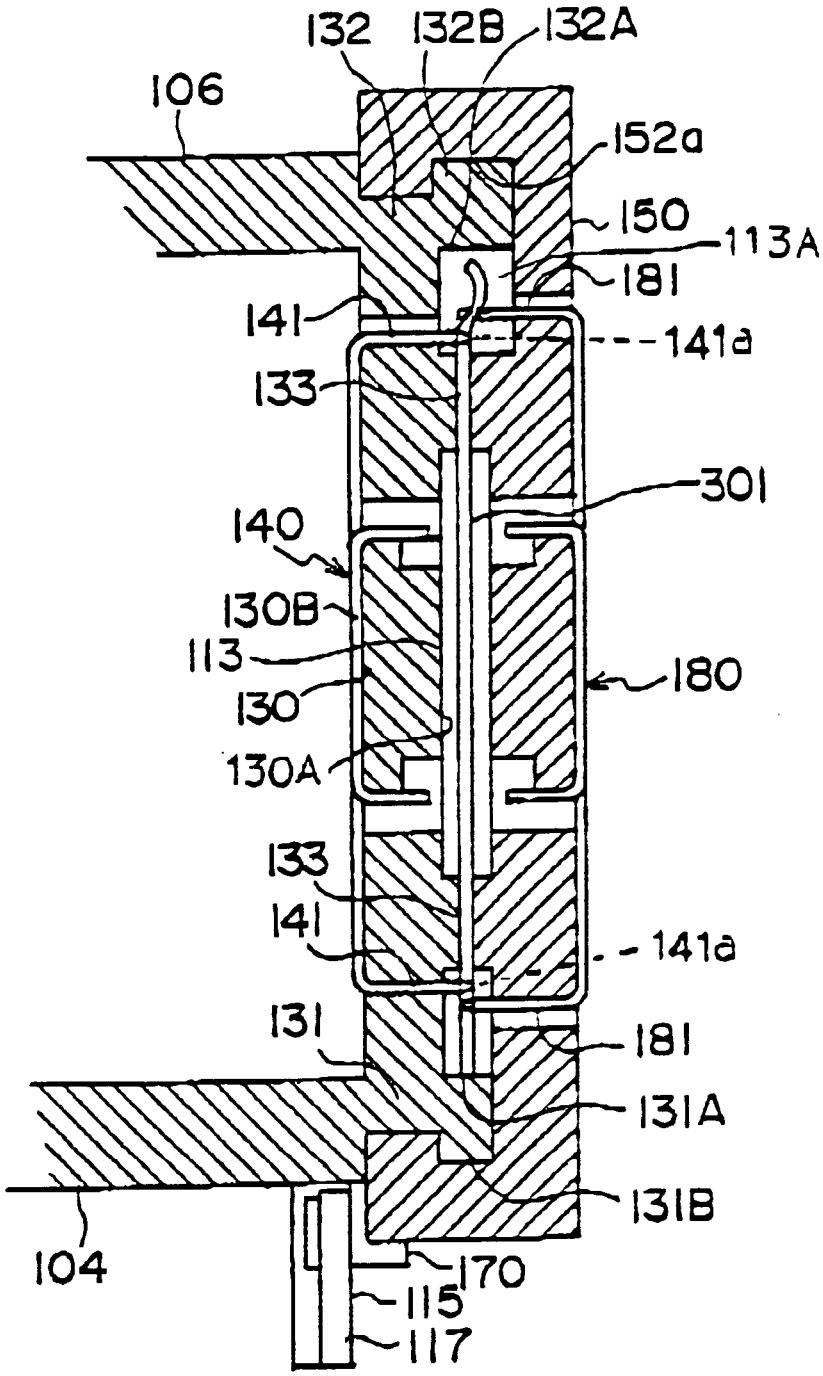
FIG. 50 is a vertical sectional view showing a slider for feeding the clip plate shown in FIG. 48, the slider being attached to the cartridge.
Figure 51:
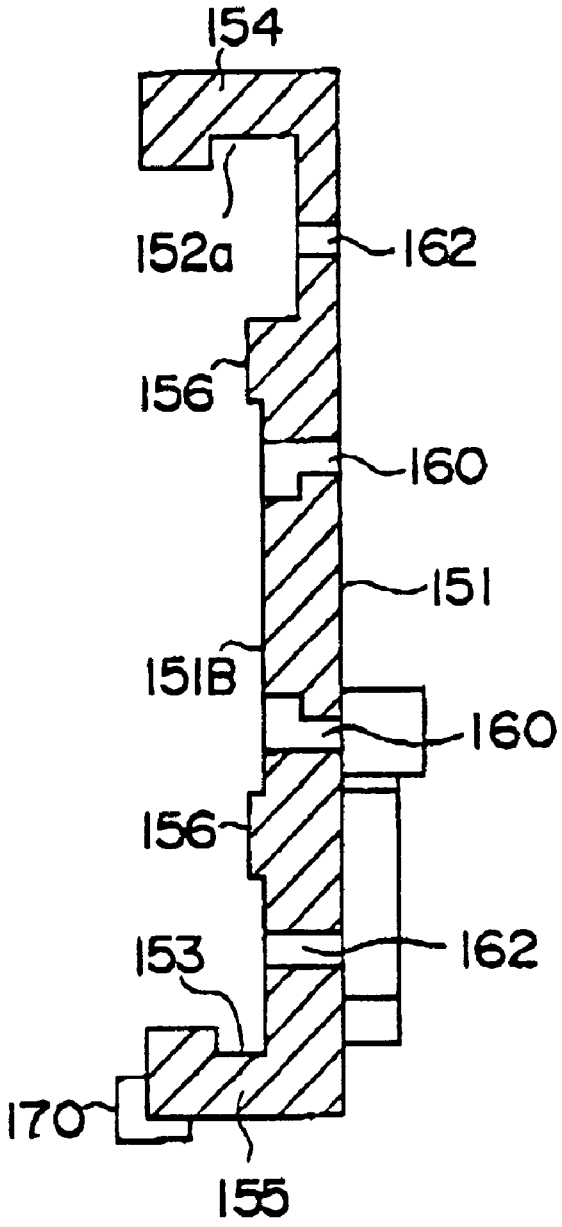
FIG. 51 is a vertical sectional view showing the slider for feeding the clip plate shown in FIG. 48.

In such a case, a space 113A for receiving the protrusion 301*a* is formed in the upper portion (one end) of the conveyer path 113, as shown in FIG. 50. The space 113A can be formed by widening the recess 152*a* of the holding portion 154 of the slider 150, as shown in FIG. 51.

Figure 52:
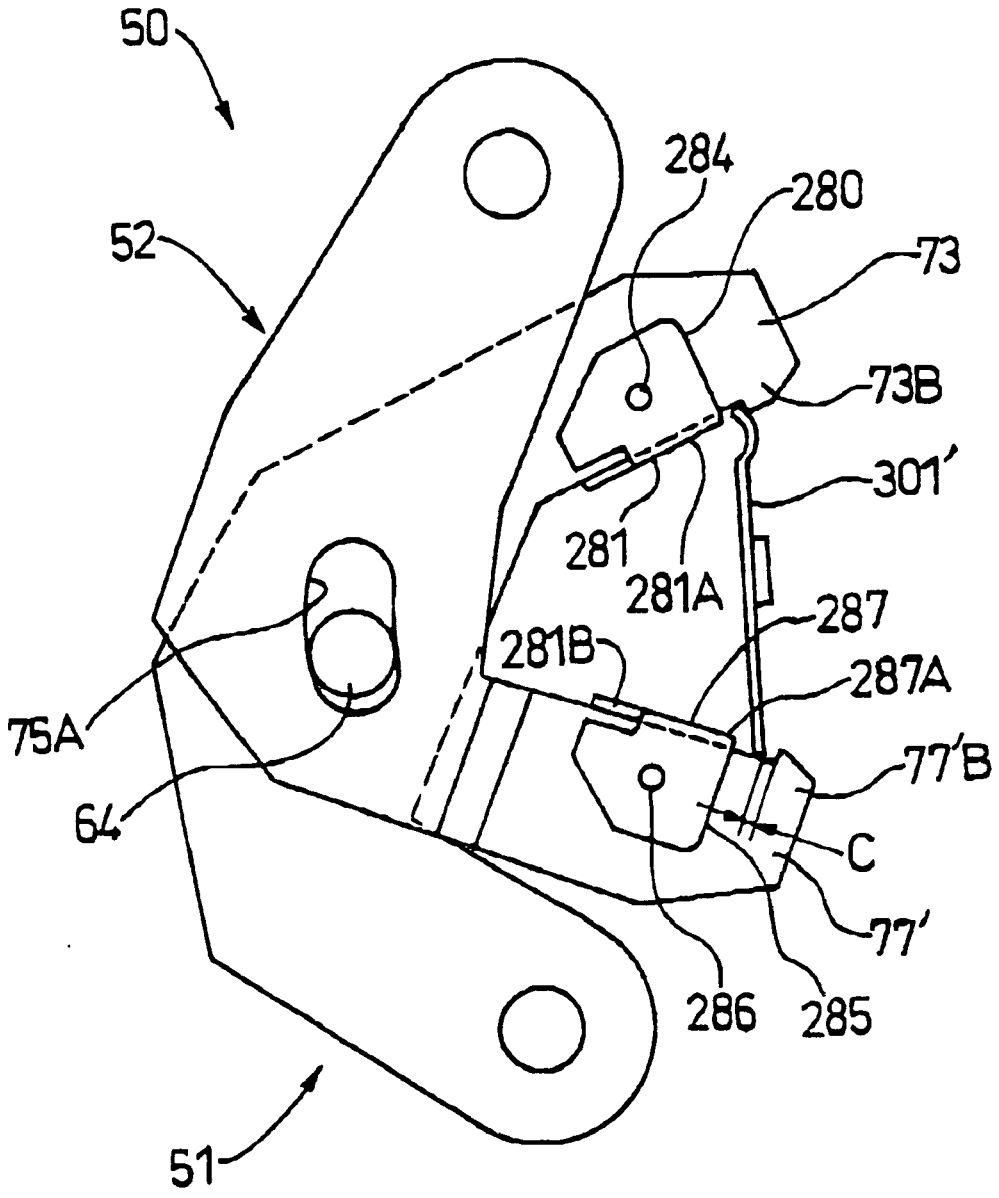
FIG. 52 is a side view showing clamp members for folding the clip plate shown in FIG. 48.

To fold the clip plate 310, a clamping mechanism 50 is used as shown in FIG. 52. If the clip plate 301 is folded by the clamping mechanism 50, it will be separated from the tape 201 at the broken line H (FIG. 49). In the clamping mechanism 50 the protrusion 77'B of a lower clamp member 52 is protruded a predetermined distance C from the protrusion 77B of an upper clamp member 51.

Figure 53:
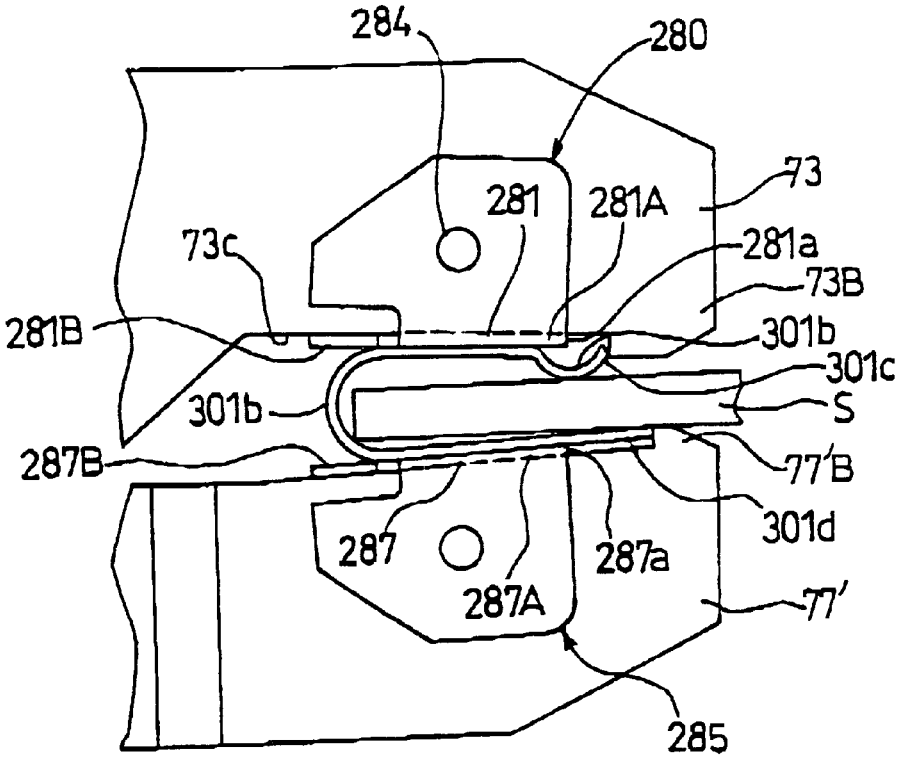
FIG. 53 is a side view showing the clamp members closed to fold the clip plate shown in FIG. 48.
Figure 54:
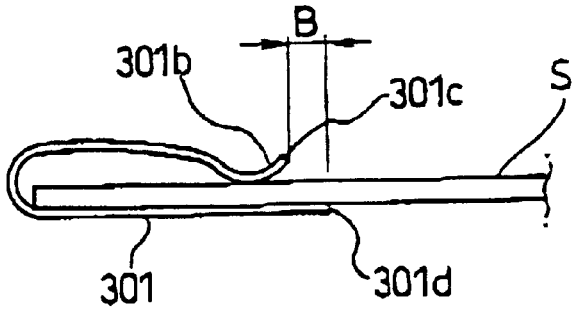
FIG. 54 is a schematic view showing a sheet bundle clipped by using the clip plate shown in FIG. 48.

If the clamp members 51 and 52 are closed, the clip plate 301' will be folded in two, as shown in FIG. 53, and the end portion 301*c* of the clip plate 301' will be faced up and positioned on the upper surface of a sheet bundle S, as shown in FIG. 54. At this time, the end portion 301*c* becomes shorter by distance B than the point end portion 301*d* of the clip plate 301' positioned on the lower surface of the sheet bundle S.

In the clipped state, the clip plate 301' is positioned on the upper surface of the sheet bundle S with the end portion 301*c* faced up and also the end portion 301*c* is offset from the point end portion 301*d* of the clip plate 301'. Therefore, even if the clip plate 301' were removed from the sheet bundle S, the sheet bundle S could easily be clipped again.

While the present invention has been described with reference to preferred embodiments thereof, the invention is not to be limited to the details given herein, but may be modified within the scope of the appended clams.

What is claimed is:

1. A cartridge, which is detachably attached to a main body of a clipping unit, for housing a connected clip body composed of a plurality of clip members interconnected in a ribbon form by a tape and wound in a roll form, said cartridge comprising:

a housing chamber for housing said connected clip body therein, said housing chamber being provided with an opening for inserting said connected clip body therethrough, the opening having substantially the same diameter as that of said housing chamber;

a cover for opening or closing said opening;

a conveyer path for conveying the clip members of said connected clip body housed in said housing chamber to a clipping position of said clipping unit; and feed means for feeding a leading clip member of said connected clip body through said conveyer path to said clipping position.

2. The cartridge as set forth in claim 1, further comprising:

lock means for locking a feed operation of said feed means, the lock means unlocking the feed operation when the cartridge is attached to the main body of the clipping unit and locking the feed operation when the cartridge is removed from the main body of the clipping unit.

3. The cartridge as set forth in claim 1, wherein said feed means includes a slider which reciprocates along said conveyer path and said slider is equipped with a feed pawl which catches one of the clip members present in said conveyer path and feeds the caught clip member forward when said slider reciprocates.

4. The cartridge as set forth in claim 3, wherein said feed pawl includes a pair of pawls provided so as to catch the opposite ends of said clip member.

5. The cartridge as set forth in claim 3, wherein said conveyer path includes a nonreturn pawl for catching said clip member present in said conveyer path and preventing the caught clip member from going backward when said slider reciprocates.

6. The cartridge as set forth in claim 5, wherein said nonreturn pawl includes a pair of pawls provided so as to catch the opposite ends of said clip member.

7. The cartridge as set forth in claim 3, wherein said feed pawl includes a pair of pawls provided before and behind said slider, respectively.

8. The cartridge as set forth in claim 5, wherein said nonreturn pawl includes a pair of pawls provided before and behind said conveyer path.

9. The cartridge as set forth in claim 1, wherein said clip member has a curved protrusion at one end thereof and said conveyer path is provided with a recess for receiving said curved protrusion at one end thereof in a direction where said clip member is fed.

* * * * *

UNITED STATES PATENT AND TRADEMARK OFFICE

CERTIFICATE OF CORRECTION

PATENT NO. : 6,112,939
DATED : September 5, 2000
INVENTOR(S) : Toru Yoshie

It is certified that error appears in the above-identified patent and that said Letters Patent is hereby corrected as shown below:

Title page, Item [54] and Column 1, line 1,
-- [54] CARTRIDGE FOR HOUSING CONNECTED CLIP BODY OF CLIP MEMBERS AND CAPABLE OF BEING ATTACHED TO MAIN BODY OF CLIPPING UNIT --

Signed and Sealed this

Ninth Day of April, 2002

*Attest:*

*Attesting Officer*

JAMES E. ROGAN
*Director of the United States Patent and Trademark Office*